US011064814B2

(12) United States Patent
Volla

(10) Patent No.: US 11,064,814 B2
(45) Date of Patent: Jul. 20, 2021

(54) DEVICE FOR SUPPORTING OR HOLDING AN INFANT OR CHILD, AS A SUPPORT OR COT

(71) Applicant: BABY TRAVEL INC., LLC, Philadelphia, PA (US)

(72) Inventor: Yang Shi Volla, Philadelphia, PA (US)

(73) Assignee: BABY TRAVEL INC., LLC, Philadelphia, PA (US)

( * ) Notice: Subject to any disclaimer, the term of this patent is extended or adjusted under 35 U.S.C. 154(b) by 435 days.

(21) Appl. No.: 15/860,569

(22) Filed: Jan. 2, 2018

(65) Prior Publication Data

US 2018/0271302 A1 Sep. 27, 2018

Related U.S. Application Data

(60) Provisional application No. 62/441,362, filed on Jan. 1, 2017.

(51) Int. Cl.
*A47D 13/00* (2006.01)
*A47D 13/02* (2006.01)
(Continued)

(52) U.S. Cl.
CPC ..... *A47D 13/02* (2013.01); *A47C 27/081* (2013.01); *A47D 9/00* (2013.01)

(58) Field of Classification Search
CPC ..... A47D 13/02; A47D 9/005; A47D 13/00
See application file for complete search history.

(56) References Cited

U.S. PATENT DOCUMENTS 2,508,304 A 5/1950 Sturtevant
2,672,628 A 3/1954 Spanel
(Continued)

FOREIGN PATENT DOCUMENTS

DE 933292 9/1955
WO WO 1990014033 11/1990
WO WO 2010000406 1/2010

OTHER PUBLICATIONS

Notification of transmittal of the International Search Report and the Written Opinion of the International Searching Authority, or the Declaration, the International Search Report, and the Written Opinion of the International Searching Authority, for International Application No. PCT/US2018/012118, dated Mar. 20, 2018, 10 pages.
(Continued)

*Primary Examiner* — Peter M. Cuomo
*Assistant Examiner* — Ifeolu A Adeboyejo
(74) *Attorney, Agent, or Firm* — Monique A. Vander Molen

(57) ABSTRACT

A device for supporting and/or holding a young child or infant is described which includes a simplicity of function, having limited components for operation of the device. The device includes a unique form (unique overall shape and design). The device comprises a top, a bottom, an outer edge forming a periphery (with or without a lip at the outer edge), and an air or gas bladder contained between the top and the bottom, and bounded by at least a portion of the outer edge. The device comprises a plurality of internal seams, at least one for forming a first wing region on a first side of a centrally located body region of the device, and at least one for forming a second wing region on a second side of the centrally located body region. The device is not only lightweight, it is also collapsible, foldable, and portable, easy to assemble, easy to operate, easy to carry, is safe when assembled, and compact when collapsed, making it suitable for home use and/or designed for travel.

20 Claims, 27 Drawing Sheets

(51) Int. Cl.
*A47D 9/00* (2006.01)
*A47C 27/08* (2006.01)

(56) References Cited

U.S. PATENT DOCUMENTS 3,173,465 A * 3/1965 Pastini ..... A45C 7/0063 150/108
3,323,147 A * 6/1967 Van Dean ..... A47D 9/005 5/98.1
3,762,404 A * 10/1973 Sakita ..... A43B 17/035 602/6
3,839,754 A 10/1974 Hooper
3,901,225 A * 8/1975 Sconce ..... A61F 5/05816 602/13
4,003,098 A * 1/1977 Fink ..... A47D 7/002 5/93.1
4,104,750 A * 8/1978 Kelter ..... A47D 9/005 5/703
4,571,760 A 2/1986 Kassai
4,670,923 A * 6/1987 Gabriel ..... A47D 15/008 5/100
4,698,862 A * 10/1987 Mairs ..... A47D 5/006 5/413 R
4,827,542 A * 5/1989 Kurtenbach ..... A47D 7/04 5/93.1
4,885,811 A * 12/1989 Hayes ..... A47D 13/02 5/81.1 T
5,060,324 A * 10/1991 Marinberg ..... A61B 6/0442 128/873
5,134,733 A 8/1992 Wetter et al.
5,265,289 A 11/1993 Swiger et al.
5,341,530 A * 8/1994 Ward ..... A47D 9/005 383/18
5,928,054 A * 7/1999 Mast ..... A63H 33/006 446/227
6,076,485 A * 6/2000 Peeples ..... A01K 1/0254 119/496
6,393,639 B1 5/2002 Ohsner
6,546,574 B1 4/2003 Bader
D506,239 S 6/2005 Peterson
6,912,743 B1 7/2005 Weil
7,037,170 B2 * 5/2006 Pacella ..... A63H 33/006 446/227
7,055,194 B2 6/2006 Arthur
7,059,000 B2 6/2006 Verbovszky
D556,284 S 11/2007 Peterson
7,404,219 B2 7/2008 Berkey
7,681,267 B1 3/2010 Hall
7,789,413 B2 * 9/2010 Hei ..... A45C 13/14 280/33.992
7,810,193 B1 * 10/2010 Ennis ..... A47D 13/08 297/219.12
7,895,690 B2 * 3/2011 Kovalyak ..... A47D 15/008 5/655
D673,789 S 1/2013 Furuland
D673,790 S 1/2013 Furuland
D681,966 S 5/2013 Slotteroy et al.
D697,336 S 1/2014 Perry
8,667,626 B2 3/2014 Zheng
9,009,887 B2 4/2015 Lo
9,326,619 B2 * 5/2016 Krass ..... A47D 13/02
9,629,759 B2 * 4/2017 Belsinger, Jr. ..... A61G 1/003
D814,824 S 4/2018 Furuland
D838,122 S 1/2019 Faniku
D852,543 S 7/2019 Clute
2002/0124311 A1 9/2002 Peftoulidis
2006/0117478 A1 6/2006 Cheung
2006/0150323 A1 7/2006 Daeseleire
2007/0277321 A1 12/2007 Leach
2008/0313812 A1 * 12/2008 Reeves ..... A47D 13/02 5/655
2010/0096419 A1 * 4/2010 Stephens ..... A47D 13/02 224/153
2010/0186165 A1 7/2010 Marciano
2011/0065344 A1 3/2011 Breuer et al.
2012/0284923 A1 * 11/2012 Jensen ..... A61G 1/00 5/627
2013/0111661 A1 5/2013 Furuland
2015/0052685 A1 * 2/2015 Bhat ..... A61G 7/001 5/715
2015/0164237 A1 * 6/2015 Kearse ..... A47C 27/084 5/652.1
2018/0192797 A1 7/2018 Yang
2019/0014921 A1 * 1/2019 Cummings ..... A47D 13/025

OTHER PUBLICATIONS

Volla, YS, U.S. Appl. No. 29/631,755, filed Jan. 2, 2018, 65 pages.
Notification concerning transmittal of International Preliminary Report on Patentability, the International Preliminary Report on Patentability, and Written Opinion of the International Searching Authority, for International Application No. PCT/US2018/012118, dated Jul. 2, 2019, 7 pages.
Machine translation of Koblischke, M., DE 933292, published Sep. 22, 1955, showing Description (4 pages), and Claims (1 page).
EP Communication containing supplementary European Search Report and the European Search Opinion, for EP Patent Application No. 18734016.1, dated Apr. 17, 2020 (8 pages).

* cited by examiner

FIG. 6
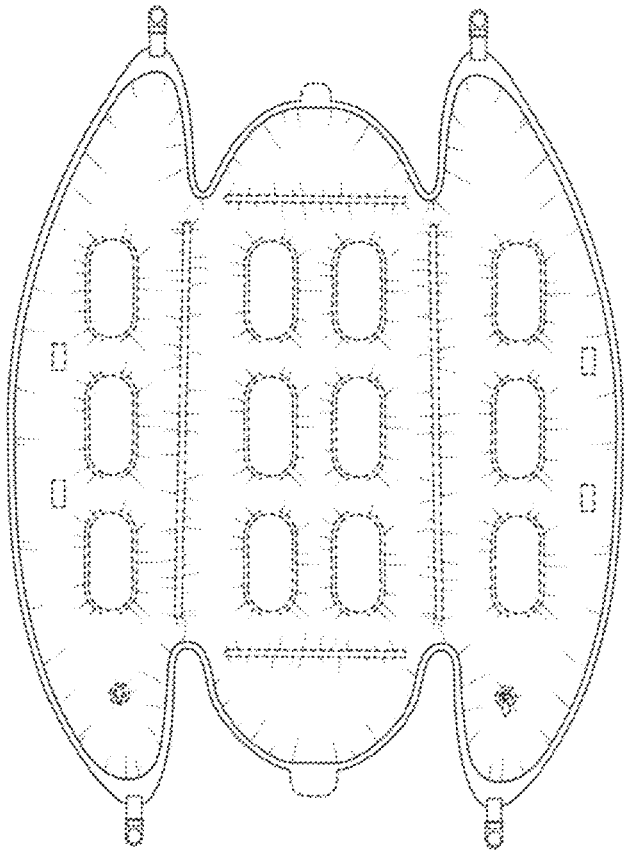
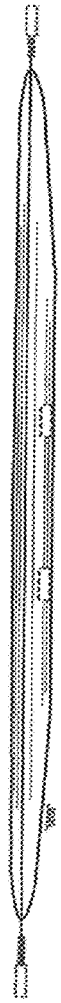
FIG. 3
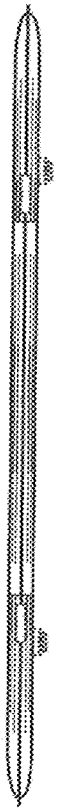
FIG. 4

FIG. 7A
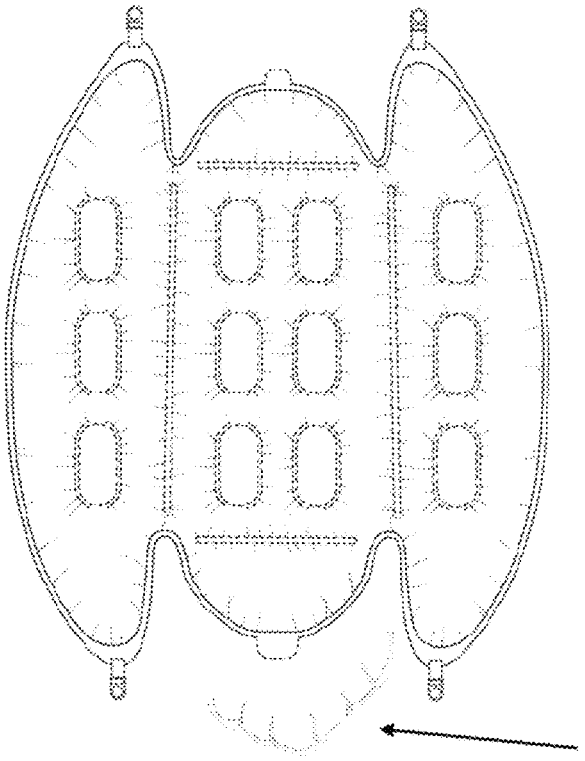
FIG. 7B
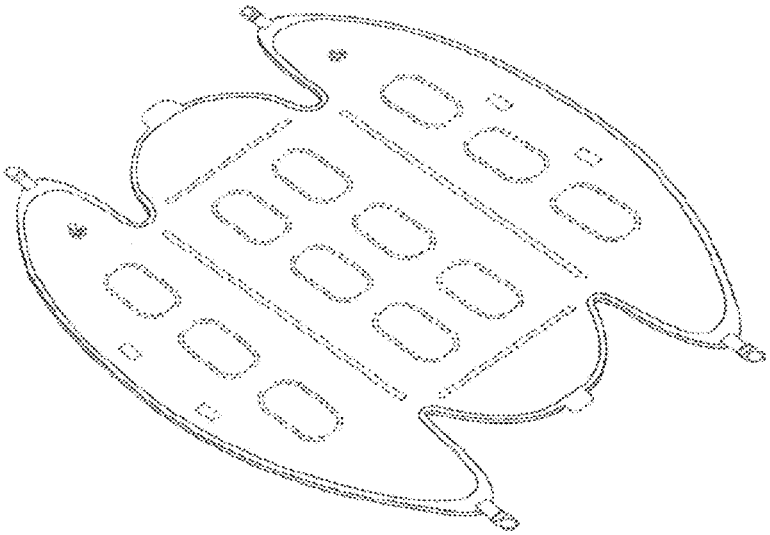
FIG. 5
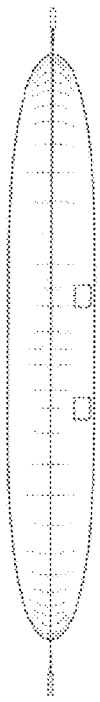
FIG. 8
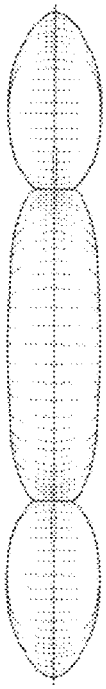
FIG. 9

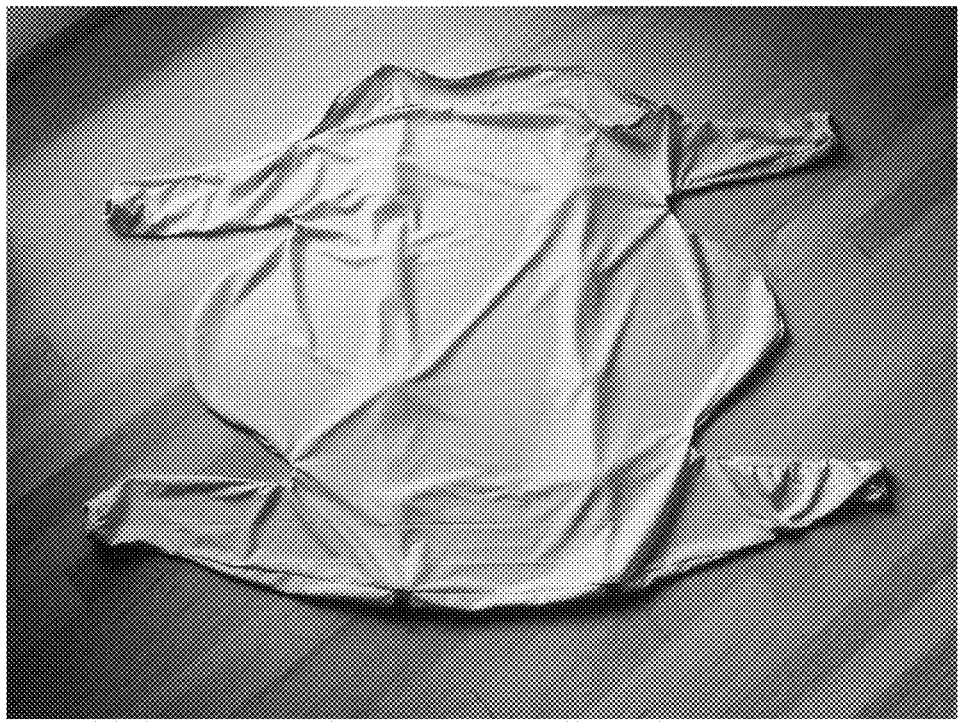
FIG. 35
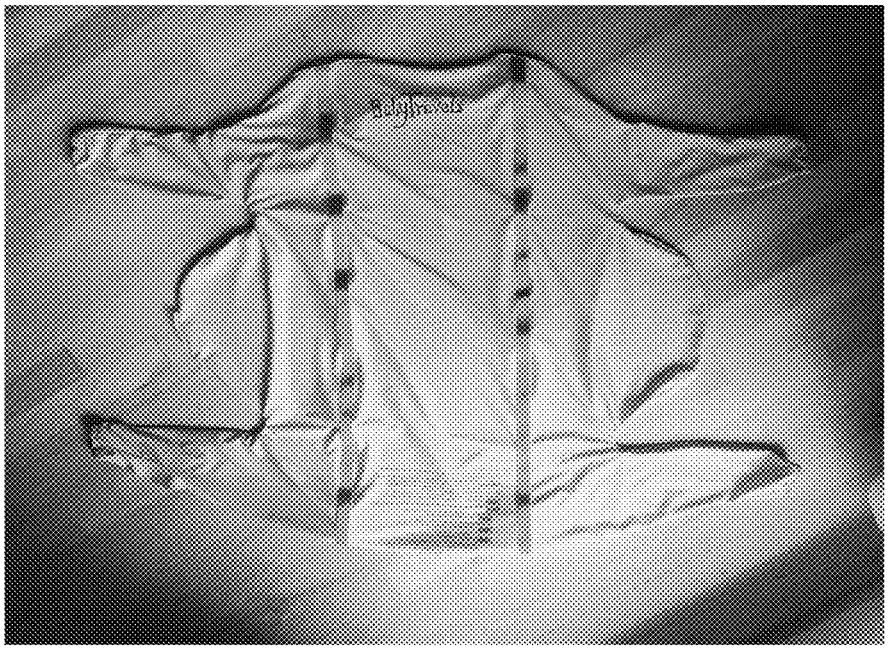
FIG. 36
FIG. 56
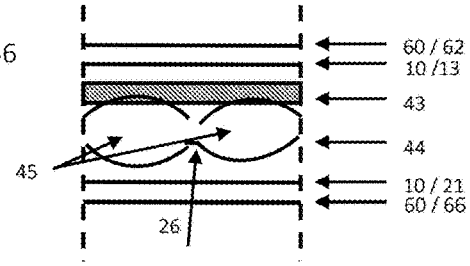

DEVICE FOR SUPPORTING OR HOLDING AN INFANT OR CHILD, AS A SUPPORT OR COT

CROSS-REFERENCE TO RELATED APPLICATION

This application claims the benefit of priority to U.S. Provisional Application No. 62/441,362, filed Jan. 2, 2017, and which is incorporated herein by reference in its entirety, and to the fullest extent available. This application also incorporates herein by reference, and in its entirety, the contents, including the specification and all drawing and drawing appendices, in a corresponding design application entitled "Infant or Child Support of Cot Unit" filed on Jan. 2, 2018.

TECHNICAL FIELD

What is disclosed, and the contents herein relate, in general, to a device, and, in particular, a device for supporting and/or holding a young child or infant.

BACKGROUND

Without limiting the scope of the disclosed invention, its background is described in connection with providing a device, in which the device is a support or cot or carrier, provided in a unique form that includes one or more features and when provided with such a device, deliver a device as a support or cot or carrier that is lightweight, collapsible, portable, inflatable and deflatable, easy to assemble, easy to operate, easy to carry, is safe when assembled, and compact when collapsed, making it suitable for home use and/or is designed for travel.

To date, available supports or cots or carriers for supporting and/or holding a young child or infant are bulky, and/or require a number of parts for assembly, and/or require a frame separate from a textile, and/or require a number of pieces and/or parts when prepared in a final form for operation (e.g., in operation as a support or cot or carrier). Often, many or at least some of the added parts or pieces are inserted within the support or cot or carrier, or within a compartment of the support or cot or carrier, and are for proper function of the support or cot or carrier in its final form (e.g., in operation as a support or cot or carrier). Indeed, many or at least some of the added part(s) or piece(s) or insert(s) are materially stiff or hard and/or as individual pieces, said individual pieces do not bend or fold. In addition, it is not uncommon to have many or at least some of the added parts or pieces serving as a base of the support or cot or carrier, such as a base on which a textile or combination of textiles are added to. There remains a need for a lightweight and portable device as a support or cot or carrier for supporting and/or holding a young child or infant that does not require more than one part (or piece) or a number of individual parts (or pieces) of the device when it is prepared in a form for operation (e.g., in operation as a support or cot or carrier). There remains a need for a lightweight and portable device for which no additional parts or pieces need to be inserted within the support or cot or carrier when prepared in its form for operation (e.g., in operation as a support or cot or carrier). There remains a need for a lightweight and portable device for which there are not individual additional parts or pieces that must be added to the device. There remains a need for a lightweight and portable device for which there are no individual additional parts or pieces that are materially stiff or hard (e.g., do not bend or fold). There remains a need for a lightweight and portable device that has no need or requirement for a further base to be added to the device for the support or cot or carrier to operate (e.g., as a support or cot or carrier). There remains a need for a lightweight and portable device, as a support or cot or carrier, that remains lightweight and portable. There remains a need for a lightweight and portable device, as a support or cot or carrier, that is easy to assemble, easy to operate, easy to fold, easy to carry, is safe when assembled, and is compact when collapsed.

SUMMARY

Described herein is a device that overcomes the disadvantages in the prior art.

Described herein is a device that meets one or more of the needs described above.

Described herein is a device that meets more than one of the needs described above.

Described herein is a device that meets all of the needs described above.

The device described herein provides a device for supporting and/or holding a young child or infant in which such a device includes a simplicity of structure, having limited components for preparation of the device. The device described herein provides a device for supporting and/or holding a young child or infant in which such a device includes a simplicity of function, having limited components for operation of the device.

The device described herein provides a device for supporting and/or holding a young child or infant in which such a device includes a unique form that is not only lightweight, it is also collapsible, foldable, and portable.

The device described herein provides a device for supporting and/or holding a young child or infant that is easy to assemble, easy to operate, easy to carry, is safe when assembled, is compact when collapsed, making it suitable for home use and/or for travel.

In one or more embodiments, the device described herein does not require a separate base, or a separate frame, or a separate stand, or separate legs for use or for function or operation of the device. Generally, in one or more forms, the device is baseless, such that it does not require a separate or separable base. Generally, in one or more forms, the device is standless, in which the device does not require a separate or separable stand. Generally, in one or more forms, the device does not include a separate or separable stand. Generally, in one or more forms, the device does not require a built-in or linked or joined stand. Generally, in one or more forms, the device does not include a built-in or linked or joined stand. Generally, in one or more forms, the device does not require separate or separable legs. Generally, in one or more forms, the device is legless. Generally, in one or more forms, the device described herein does not require additional and separate support member that hold or support the described device when operating and/or when utilizing the device, such as when utilizing the device for supporting and/or holding a young child or infant. Generally, in one or more forms, the device described herein does not require additional and separate support member to hold or support the device in position when operating the device and/or when utilizing the device, such as when utilizing the device for supporting and/or holding a young child or infant. In one or more embodiments, there are no additional external support members (particularly individually inflexible support members) to hold or support the described device in position and/or when utilizing the device (e.g., no separate base members, no separate stand, no separate legs). In one or more embodiments, there are no additional internal support members (e.g., separate or individual support members, particularly inflexible support members) to hold or support the described device in position and/or when utilizing the device (e.g., no required added ribbing or insert member).

In one or more embodiments, the device described herein does not require fastening or affixing together one or more independent (separate) parts for preparing the device (e.g., for preparing the device for operation). Generally, in one or more embodiments, the device, itself, is provided as one piece and/or one unit, in which all parts are pre-assembled, requiring no further assembly with additional independent parts. In one or more embodiments, the device, itself, is provided as one unit, in which parts are pre-assembled. In one or more embodiments, the device, itself, is provided as one unit, in which parts are pre-assembled, and the unit is provided in a carrier. In one or more embodiments, the device, itself, is provided as one unit, in which parts of the unit are pre-assembled and pre-affixed (pre-joined) together. In one or more embodiments, the device, itself, is provided as one unit, in which parts are pre-assembled, and the unit is provided in a cover and/or a carrier.

Generally, in one or more forms, the device described herein does not require any further or separate elements or members, or independent parts, or inserts in the device that are for maintaining a shape or position of the device. Generally, in one or more forms, the device described herein does not require any further elements or separate elements, or independent parts, or inserts in the device for maintaining a shape or position of the device once the device is prepared for operation (e.g., operation as a support or cot or carrier).

In one or more embodiments, the device described herein is collapsible. Generally, in one or more forms, the device described herein collapses without having or requiring removal of one or more essential parts from the device when collapsing, such essential parts or elements or inserts being ones that are utilized or necessary for supporting or for shaping the device, and/or are for final function of the device (i.e., for supporting and/or holding a young child or infant). Generally, in one or more forms, the device described herein collapses without a need to physically remove necessary device parts or necessary elements from the device when collapsing.

In one or more embodiments, the device described herein is foldable. Generally, in one or more forms, the device described herein is foldable to a smaller size. The smaller size may be one that is compact, one that may fit in a backpack, or in a carry-on suitcase, or in a purse, or in a shoulder bag. Generally, in one or more forms, the device described herein is foldable without requiring a physical removable of parts or elements from the device, the parts or elements being parts that are required for final function and operation of the device (i.e., for supporting and/or holding a young child or infant). In one or more forms, the device described herein is foldable without requiring a physical removal of a part or element of the device, the part or element for the necessary function of the device when it is being utilized (e.g., for supporting and/or holding a young child or infant, excluding any accessory, such as extra cover, overhead accessory, and/or handle). Generally, in one or more forms, the device described herein is foldable without requiring a physical removable of any necessary or functional device part(s) or element(s) from the device when folding. In one or more embodiments, said device may be folded or otherwise placed or positioned in an accompanying carrying case or bag, when appropriate or when desired.

In one or more embodiments, the device described herein is portable. Generally, in one or more forms, the device described herein is lightweight, and, also being foldable, is thereby capable of being carried and is readily and easily movable. Generally, the device described herein is, in one or more forms, designed for packing, and for being moved, and is suitable for both long- and short-distance travel. Having a simplicity of elements, and of operation, the described device (alone and/or with or in an accompanying carrying bag or case or vessel) is easy to utilize, and easy to move from one location to another, In one or more embodiments is a device that is a device for supporting and/or holding a young child or infant, the device comprising, in one or more forms, one unit for supporting and/or holding the young child or infant. In one or more embodiments, the one unit is a pre-assembled unit. In one or more embodiments, the one unit is one complete component. In one or more embodiments, the one unit is one assembled component. The device, comprising the unit or the component (e.g., one unit or one component) for supporting and/or holding the young child or infant, may be transposed from a first position to a second position. The device, comprising the unit or the component (e.g., one unit or one component) for supporting and/or holding the young child or infant, may also be transposed from the second position to a third position. Still further, the device, comprising the unit or the component (e.g., one unit or one component) for supporting and/or holding the young child or infant, may also be transposed from the third position to a second position. Even further, the device, comprising the unit or the component (e.g., one unit or one component) for supporting and/or holding the young child or infant, may also be transposed from the second position to a first position. Yet further, the device, comprising the unit or the component (e.g., one unit or one component) for supporting and/or holding the young child or infant, may also be transposed from the first position to at least one fourth position.

The first position may comprise a generally unfolded and open position. The first position may comprise a deflated position. The second position may comprise an unfolded and open position. The second position may comprise an inflated position. The third position may comprise an unfolded and open yet enclosed position. The third position may comprise an inflated position. The at least one fourth position may comprise a folded and/or closed position. The fourth position may comprise a deflated position. In one or more embodiments, the transposing from the fourth position to the first position, from the first position to the second position, and/or from the second position to the third position, requires no additional parts of the device, parts that are physically positioned onto the device and essential for the final operation of the device. Similarly, in one or more embodiments, the transposing from the third position to the second position, from the second position to the first position, and/or from the first position to the fourth position, requires no additional parts of the device and does not require removal of any additional parts of the device (e.g., parts that would be physically removed from the device or would be essential for the final operation of the device).

Generally, in one or more forms, is provided a device for supporting and/or holding the young child or infant, the device comprising an air or gas bladder, and having a unique and irregular form (non-polygonal), including a top surface, a bottom surface, an outer edge on a periphery, in which the outer edge comprises a lip, and a plurality of internal seams. In one or more forms, the internal seams are seams (e.g., a seam via one or more of heat, fusion, welding, glue, and the like, having two side edges and a seamed region therebetween). In one or more forms, one or some, or many, or most, or all, of the internal seams are double seams (e.g., wide seam via one or more of heat, fusion, welding, glue, and the like, having double [two] side edges and a seamed region therebetween). The device may further comprise one or more inlets. The device may further comprise one or more projections. The one or more projections may include one or more enclosures, fasteners, or means for securing, enclosing, and/or fastening (e.g., securement or fastener, such as one or more of a clasp, belt, buckle, hook and/or loop, clip, lock, chain, zip, button and/or hole, pin and/or hoop, retaining ring, anchor, carabiner, and the like, as understood in the art, or as developed in the art for securing or fastening in a suitable manner appreciated by one of skill in the art). The one or more projections may comprise a hold or a holding means (e.g., hold mechanism or element, such as one or more of a clasp, belt, buckle, hook and/or loop, clip, lock, chain, zip, button and/or hole, pin and/or hoop, retaining ring, anchor, carabiner, and the like, or on a clasp, belt, buckle, hook and/or loop, clip, lock, chain, zip, button and/or hole, pin and/or hoop, retaining ring, anchor, carabiner, and the like, as is understood in the art, or as developed in the art for holding when there is a securing or fastening, or when secured or fastened, in a suitable manner appreciated by one of skill in the art). The one or more projections may comprise a release or a releasing means (e.g., release mechanism or element, such as one or more of a clasp, belt, buckle, hook and/or loop, clip, lock, chain, zip, button and/or hole, pin and/or hoop, retaining ring, anchor, carabiner, and the like, or on a clasp, belt, buckle, hook and/or loop, clip, lock, chain, zip, button and/or hole, pin and/or hoop, retaining ring, anchor, carabiner, and the like, as is understood in the art, or as developed in the art for releasing when there is a securing or fastening, or when secured or fastened, in a suitable manner appreciated by one of skill in the art). The one or more projections may include a handle. The one or more projections may include an overhead companion.

The device described herein provides a unique form, for supporting and/or holding the young child or infant, the form generally comprising a body, a first wing, and a second wing. The body is generally a central body or central region having a first side and a second (opposing) side. The first wing is disposed on the first side of the body. The second wing is disposed on the second side of the body. The first wing and the second wing may be of the same general shape and size. The first wing and the second wing may be of different shapes and sizes. Associated with the first wing and the second wing may be one or more projections. Associated with the first wing and the second wing may be one or more enclosures, fasteners, or means for securing, enclosing, and/or fastening (e.g., securement, or fastener, or such as one or more of a clasp, belt, hook or loop, clip, lock, chain, zip, button or hole, pin or hoop, retaining ring, anchor, carabiner, and the like, as understood in the art, or as developed in the art for securing or fastening in a suitable manner appreciated by one of skill in the art, and/or having one or more holding mechanisms or elements, and/or release mechanisms or elements). Associated with the first wing and/or the second wing may be one or more inlets.

Between the body and the first wing may be at least one first partition. The at least one first partition may be a seam as described herein. The at least one first partition may be a double seam as described herein. Generally, in one or more embodiments, the at least one first partition is provided as a discontinuous partition for at least facilitating a partial separation between the first wing and the body. Between the body and the second wing may be at least one second partition. The at least one second partition may be a seam as described herein. The at least one second partition may be a double seam as described herein. The body may further comprise additional partitions. For example, the body may further comprise a partition at a front end or front region of the body, the partition at the front end or front region of the body provided as a partition for at least facilitating some separation between the front end or region of the body, and an adjacent region, or between the front end or region of the body and a more central region of the body. The body may further comprise a partition at a front end or front region of the body, the partition at the front end or front region of the body provided as a discontinuous partition for at least facilitating a partial separation between the front end or region of the body, and an adjacent region, or between the front end or region of the body and a more central region of the body. In another example, the body may further comprise a partition at a rear end or rear region of the body, the partition at the rear end or rear region of the body provided as a partition for at least facilitating some separation between the rear end or rear of the body, and an adjacent region, or between the rear end or region of the body and a more central region of the body. The body may further comprise a partition at a rear end or rear region of the body, the partition at the rear end or rear region of the body provided as a discontinuous partition for at least facilitating a partial separation between the rear end or rear of the body, and an adjacent region, or between the rear end or region of the body and a more central region of the body. Further partitions may be provided in the body. Such partitions may be of any shape or size. In one or more embodiments, such partitions may be generally discontinuous, thereby offering some continuity, and not operating as complete barriers. In addition, or as an alternative, further partitions may be provided in the first wing and/or the second wing. Such partitions in the first wing and/or the second wing may also be of any shape or size, being generally discontinuous, and thereby offering some continuity, and not operating as complete barriers. The further partitions may be seams, or may be double seams, or some combination thereof.

The described device for supporting and/or holding a young child or infant is provided as a flexible device for supporting and/or holding a young child or infant. In one or more embodiments, the described device comprises a flexible material, one that, on its own, is not a stiff material.

The unique form of the described device is often provided as waterproof, and/or washable, comprising materials that are waterproof, and/or washable. The unique form is generally provided as hypoallergenic, comprising one or more materials that are hypoallergenic. The unique form is generally provided as hygienic, comprising one or more materials that are hygienic. The unique form is often provided as durable, waterproof, and/or washable, comprising one or more materials that are durable, waterproof, and/or washable. The unique form is often provided in a non-slip or a less-slip form, such as by comprising one or materials that are non-slip or offer less slip (e.g., as compared to materials considered to have slip).

The device for supporting and/or holding a young child or infant may further comprise one or more accessories, such as a cover, a handle, an overhead companion, and/or a pump or inflating mechanism.

In one or more embodiments, the described device is provided as a kit in which the described device is provided in addition to the one or more accessories, or with a plurality of the one or more accessories, the accessories including, but not limited to, the cover, the handle, the overhead companion, and the pump or inflating mechanism.

In one or more embodiments is a device for supporting and/or holding a young child or infant further comprising at least a pump or inflating mechanism. In some embodiments, the pump or inflating mechanism may be an air or gas micro inflator or micro pump or miniature pump, as is known in the art, or as developed in the art and suitable for use with the described device, which may or may not be computer controlled, and/or associated with or incorporating an integrated circuit (e.g., microelectromechanical or MEMS technology). The pump or inflating mechanism may be piezoelectric, electric, and/or mechanically actuated (valve, or valve less). In one or more embodiments, the pump or inflating mechanism may also deflate or include a deflating mechanism. In one or more embodiments, the pump or inflating mechanism is in proximity with the device, and/or is securable to the device. In one or more embodiments, the pump or inflating mechanism is in a compartment of the device (e.g., holder, pocket, recess).

In one or more embodiments is a device for supporting and/or holding a young child or infant further comprising at least a cover. In some embodiments, the cover encompasses the entire device. In some embodiments, the cover encompasses at least a portion of the device, such as a top surface of the device, and/or the body portion of the device, such as some or all of the portion of the device that may is used to support the child or infant. The cover may further comprise a cover and/or serve as a cover. The cover may be hypoallergenic, comprising at least one material that is hypoallergenic. The cover may be hygienic, comprising at least one material that is hygienic. The cover may be waterproof, comprising at least one material that is waterproof. The cover may be washable, comprising at least one material that is washable. In one or more embodiments, the cover is a combination of one or more of hypoallergenic, hygienic, waterproof, and washable, and various combinations thereof. The cover may further comprise or serve as padding. The cover may further comprise a material that is suitable for good (long lasting) durability. The cover may further include one or more reinforcements, access hole(s), holder(s), pocket(s), and/or comprise additional options for including one or more accessories, or a plurality of one or more accessories, including but not limited to a handle, an overhead companion, and/or a pump or inflating mechanism.

In one or more embodiments is a device for supporting and/or holding a young child or infant further comprising at least an overhead companion. In some embodiments, the overhead companion is associated with, securable to, and/or affixed to the described device, utilizing suitable mechanism(s) for associating, securing, and/or affixing, as is known in the art, or as developed in the art and suitable for use with the described device (e.g., means for securing and/or fastening, such as a securement or fastener, including but not limited to one or more of a clasp, buckles, belt, hook and loop, clip, lock, chain, zip, button and hole, pin or hoop, retaining ring, anchor, carabiner, and the like, as understood in the art, or as developed in the art for securing or fastening in a suitable manner appreciated by one of skill in the art, and/or having one or more holding mechanisms or elements, and/or release mechanisms or elements). In some embodiments, the overhead companion is associated with, securable to, and/or affixed to the cover of the described device, utilizing suitable mechanism(s) for associating, securing, and/or affixing, as is known in the art, or as developed in the art and suitable for use with the described device, such as described above. In one or more embodiments, the overhead companion is inflatable and deflatable. In one or more embodiments, the overhead companion is foldable.

In one or more embodiments is a device for supporting and/or holding a young child or infant further comprising at least a handle. In some embodiments, the handle is an extension of the described device, and may comprise a same material as the device. In some embodiments, the handle is associated with, securable to, and/or affixed to the described device, utilizing suitable mechanism(s) for associating, securing, and/or affixing, as is known in the art, or as developed in the art and suitable for use with the described device (e.g., means for securing and/or fastening, such as a securement or fastener, including but not limited to one or more of adhesive, clasp, buckles, belt, hook and loop, clip, lock, chain, zip, button and hole, pin or hoop, retaining ring, anchor, carabiner, and the like, as understood in the art, or as developed in the art for securing or fastening in a suitable manner appreciated by one of skill in the art, and/or having one or more holding mechanisms or elements, and/or release mechanisms or elements). In some embodiments, the handle is associated with, securable to, and/or affixed to the cover of the described device, utilizing suitable mechanism(s) for associating, securing, and/or affixing, as is known in the art, or as developed in the art and suitable for use with the described device, such as described above. In one or more embodiments, the handle is removably associated with, removably securable to, and/or removably affixed to the cover of the described device, utilizing suitable mechanism(s) for removably associating, removably securing, and/or removably affixing, as is known in the art, or as developed in the art and suitable for use with the described device, such as described above.

As descried herein is a device for supporting or holding a young child or infant, the device comprising a top, a bottom, an outer edge forming a periphery, in which the outer edge further comprises a lip at the periphery, and an air or gas bladder contained within or between the top and the bottom, and bounded by at least a portion of the lip of the outer edge. The device having a unique and irregular or non-polygonal form, and defined by a plurality of seams, the plurality of seams forming a first wing region and second wing region of the device, the first and second wing regions each comprising a portion of the top and a portion of the bottom. The first wing region and the second wing region being separated by a body region. At least some of the plurality of seams may also provide the lip at the periphery of the device. The device being inflatable via the air or gas bladder to expand the top and the bottom. The device is further operable between a first or open position and a second or closed position, and variations therebetween, wherein the closed position raises at least a portion of the bottom of the first and second wing regions away from a surface on which the device is positioned. In the described device, at least some of the seams are double seams. In the described device, at least some of the seams or double seams are any one or more of adhered seams, welded seams, fused seams, and variations thereof. In the described device, the device may further comprise one or more projections. In the described device, the one or more projections are selected from a group comprising one or more enclosures, fasteners, clasps, buckles, belts, hooks and loops, clips, locks, chains, zips, buttons and holes, pins, hoops, retaining rings, anchors, carabiners, and combinations thereof. In the described device, at least some of the one or more projections may be utilized to operate the device between the first or open position and the second or closed position. In the described device, at least some of the one or more projections may be utilized to restrain the device in the second or closed position. The described device may further comprise at least one gas or air inlet. With the described device of at least claim 1, one or more projections may further comprise one or more of at least one handle, and/or overhead element. The described device may further comprise a cover. The described device may further comprise at least one cover. The described device may further comprise padding. The described device may further comprise one or more of a reinforcement, an access hole, holder, pocket, overhead companion, and a pump or inflating mechanism, any or all of which may be cooperative with the device. The described device may further comprise one or more hinge regions for movement of the device (e.g., a portion of the device) from a first position, in a same plane (e.g., the device—comprising at least the first wing region, the second wing region, and the body region—being in a same and first plane), to a second position, in second plane (e.g., a portion of the device—comprising a portion of the first wing region, the second wing region, and/or the body region—being in a second plane as compared with the same and first plane). The described device may further comprise one or more handles. The described device may further comprise a micropump. The described device may further comprise a cover. The cover may be a first cover. The cover may be a first and second cover. The described device may further comprise a first cover and a second cover. The described device may further comprise at least one cover with at least one handle. The described device may be used for travel. The described device may be used for support of the young child or infant, such as in a first location. The described device may be used for support of the young child or infant, such as from a first location to a second location.

As further described herein is a method of preparing the device as described and claimed, the method comprising inflating the device, and fastening wings of the device. The method may further comprise providing the young child or infant on the body of the device when the body is inflated. The method may further comprise having a cover over at least the body of the device when the device is inflated. The method may further comprise having a cover over at least the body and portions of the wings of the device when the device is inflated. The method may further comprise providing a cover over at least the body of the device when the device is deflated. The method may further comprise providing a cover over at least the body and portions of the wings of the device when the device is deflated.

These and additional embodiments are described below.

BRIEF DESCRIPTION OF THE DRAWINGS

Various embodiments will be explained in more detail with reference to the drawings in which:

FIG. 3 depicts a schematic of an edge of the representative embodiment of FIG. 1A;

FIG. 4 depicts a schematic of another edge of the representative embodiment of FIG. 1A;

FIG. 5 depicts in perspective view a schematic of the representative embodiment of FIG. 1A;

FIG. 6 depicts a schematic of a top of another representative embodiment of a device described herein;

FIG. 7A depicts a schematic of a bottom of the representative embodiment of FIG. 6;

FIG. 7B depicts a schematic of edging of the representative embodiment of FIG. 7 when inflated;

FIG. 8 depicts a schematic of an edge of the representative embodiment of FIG. 6;

FIG. 9 depicts a schematic of another edge of the representative embodiment of FIG. 6;

FIG. 35 illustrates a top view of a representative embodiment and prototype of a cover of a device as described herein;

FIG. 36 illustrates a bottom view of the representative embodiment and prototype of FIG. 35;

FIG. 56 schematically illustrates in cross-section a portion of a mid-section of a device as described herein.

DETAILED DESCRIPTION

Figure 1A:
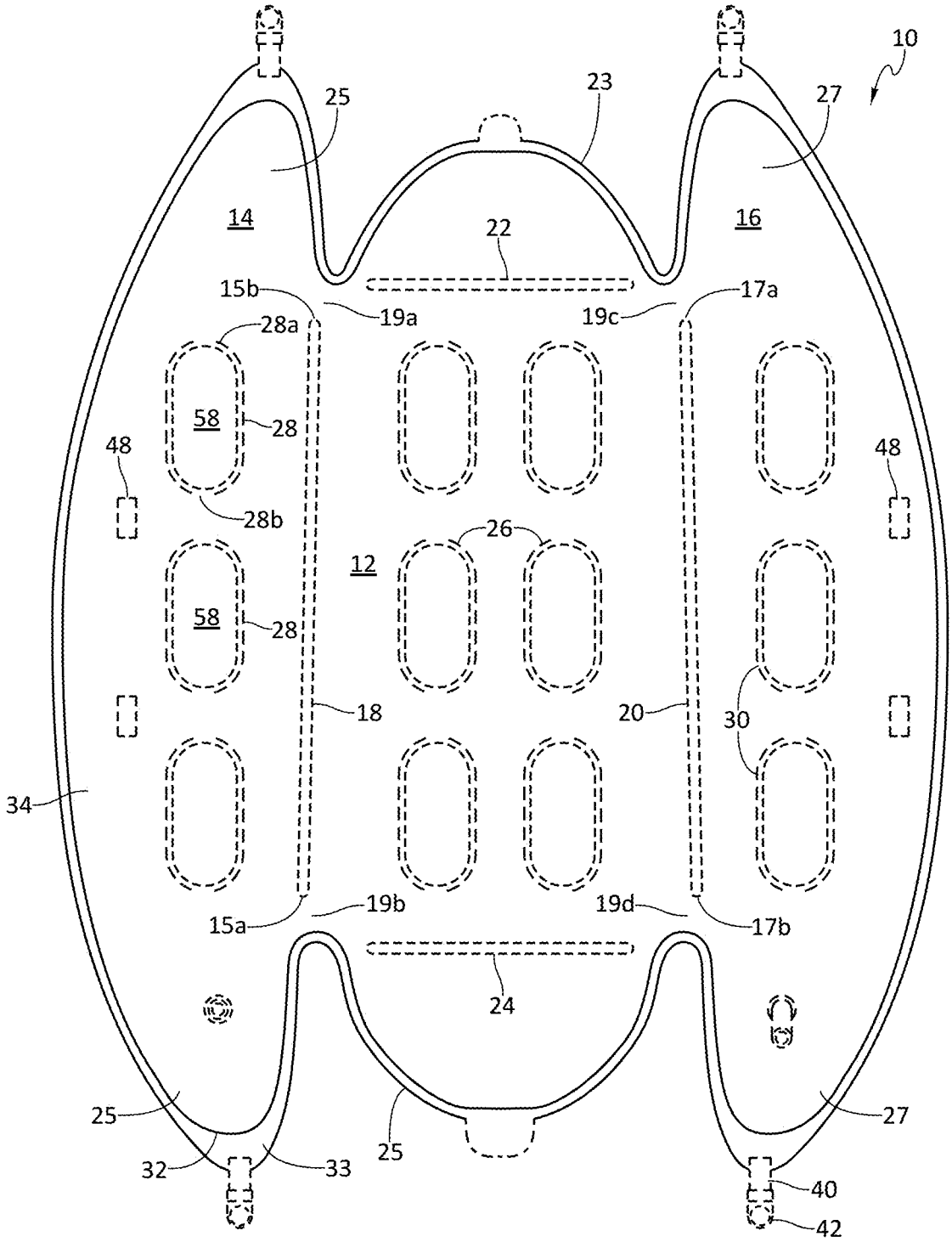
FIG. 1A depicts a schematic of a top of a representative embodiment of a device Zdescribed herein.

Although making and using various embodiments are discussed in detail below, it should be appreciated that as described herein are provided many inventive concepts that may be embodied in a wide variety of contexts. Embodiments discussed herein are merely representative and do not limit the scope of the invention.

The device described herein is a portable device for supporting and/or holding a young child or infant, a foldable device for supporting and/or holding a young child or infant, an inflatable device for supporting and/or holding a young child or infant, as depicted in at least FIGS. 1-11, and FIGS. 1-56. It is understood that the device is not limited to the embodiments of FIGS. 1-11, and FIGS. 1-56; a person skilled in the relevant art will appreciate that additional embodiments are described herein, and are possible, without deviating from the concept of a device that is for supporting and/or holding a young child or infant while, in the manner described herein, being portable, foldable, and inflatable. Any such additional embodiments will fall within the scope, including other appropriate materials that may be developed, and/or other appropriate configurations, shapes, and/or sizes that may support and/or hold a young child or infant. It is understood that any such embodiments can be readily incorporated into the teachings provided herein.

A representative embodiment of the device described herein is device 10 of FIGS. 1-11. Device 10 includes a body 12 and wings 14, 16. Wing 14 is positioned adjacent a first side of body 12. Also, adjacent the first side of body 12 is hinge region 18, providing at least a partial separation or partitioning of body 12 and wing 14. Hinge region 18 also provides a moveable joint, allowing wing 14 to elevate with respect to body 12, when body 12 is coplanar with (e.g., initially coplanar with wing 14) and/or placed on a supporting surface, such as a floor. Wing 16 is positioned adjacent a second side of body 12. In addition, a hinge region 20 is adjacent the second side of body 12, providing at least a partial separation or partitioning of body 12 and wing 16. As such, body 12 is bounded on its first and second side by hinge regions 18, and 20, respectively. Hinge region 20 also provides a moveable joint, allowing wing 16 to elevate with respect to body 12, when body 12 is coplanar with (e.g., initially coplanar with wing 14) and/or placed on a supporting surface, such as a floor. Hinge regions 18 and/or 20 may be wider or narrower than shown. Hinge regions 18 and/or 20 may also include a plurality of hinge regions, provided in parallel (not shown), and/or in series (e.g., FIG. 1B, hinge regions 18*a*, 18*b*, 18*c*, 20*a*, 20*b*, 20*c*).

Figure 1B:
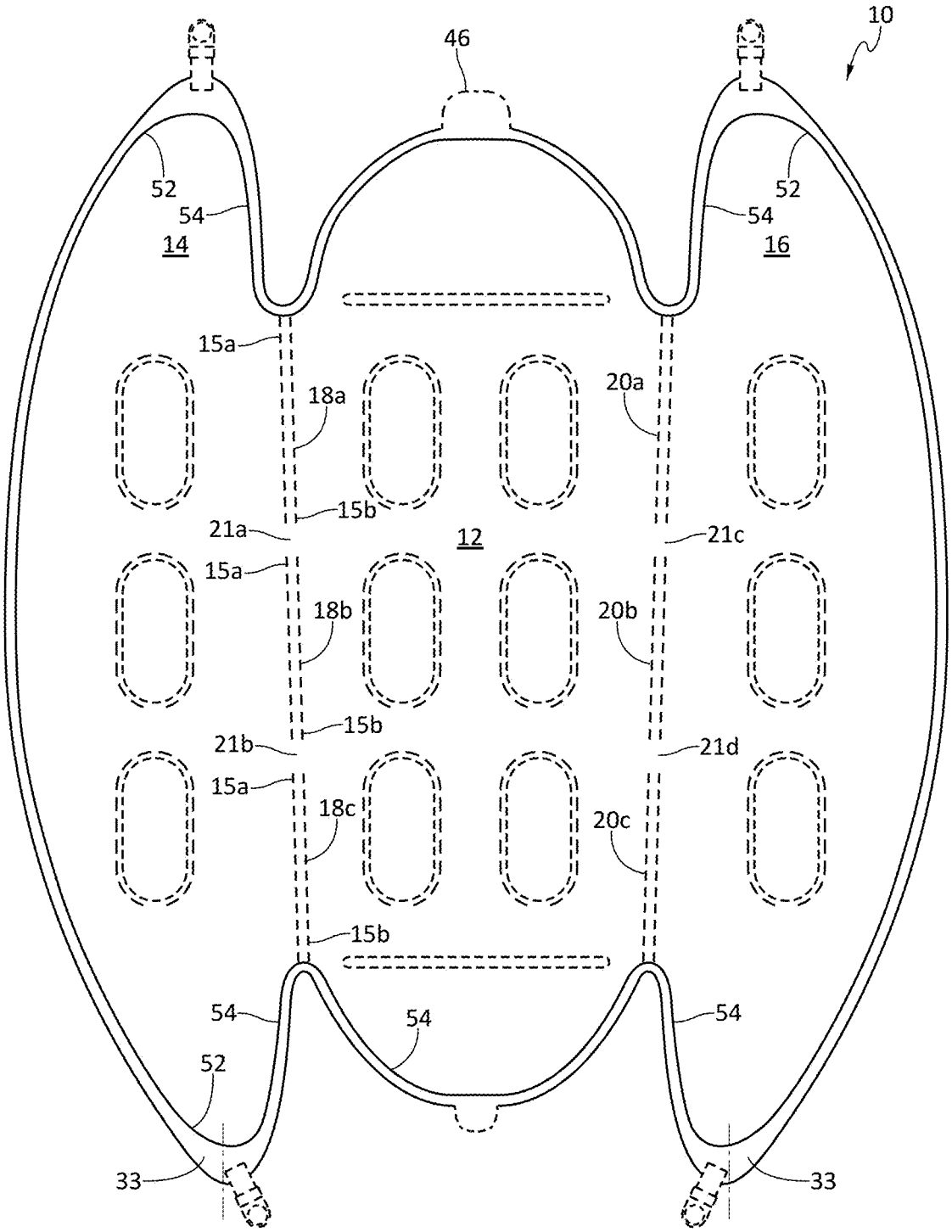
FIG. 1B depicts a schematic of a top of another representative embodiment of a device described herein.
Figure 2:
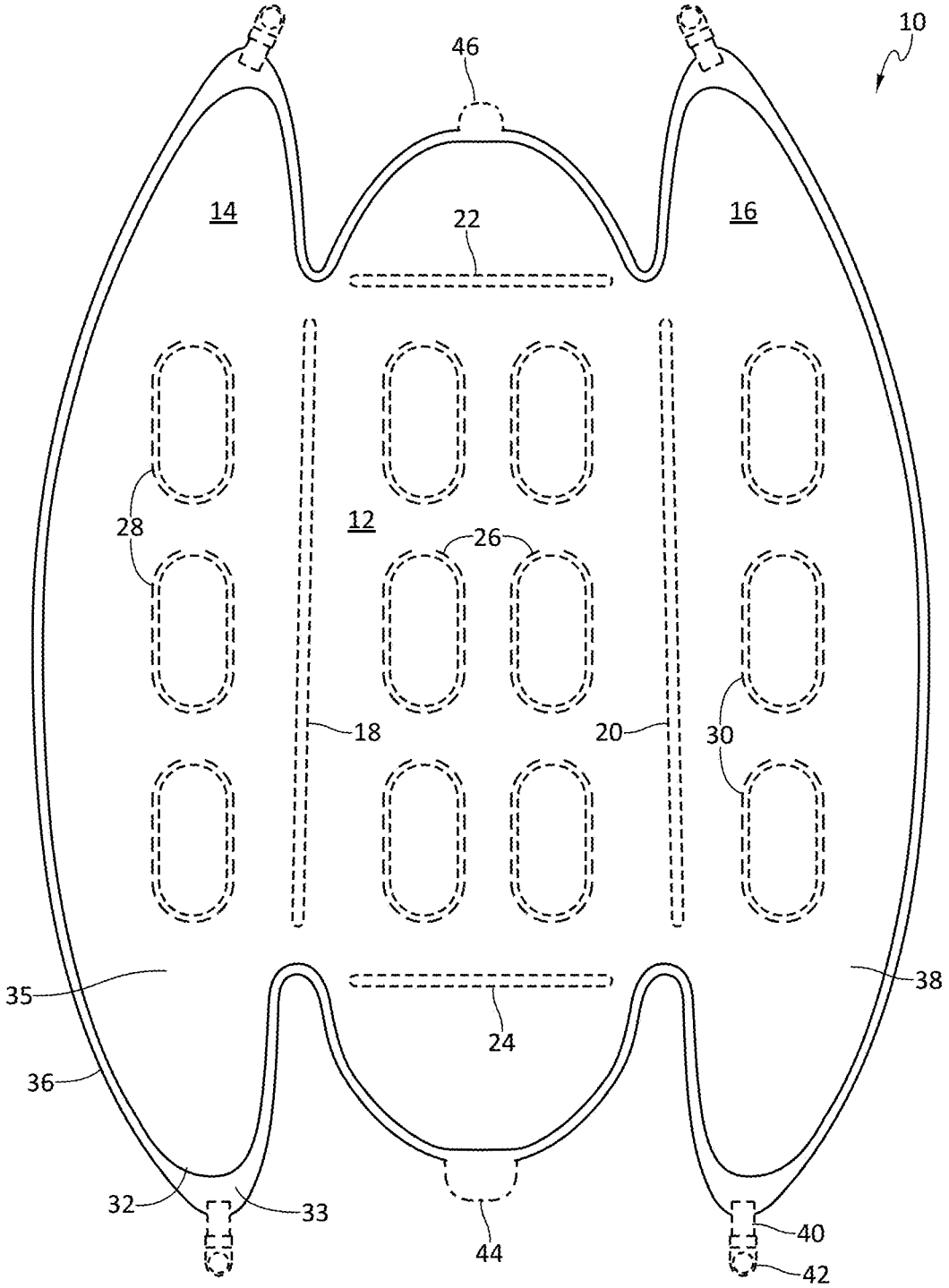
FIG. 2 depicts a schematic of a bottom of the representative embodiment of FIG. 1A.
Figure 10:
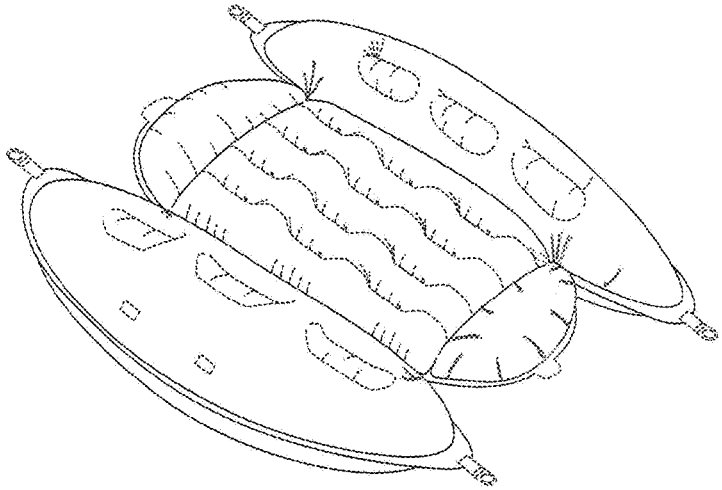
FIG. 10 depicts in perspective view a schematic of the representative embodiment of FIG. 6.
Figure 11:
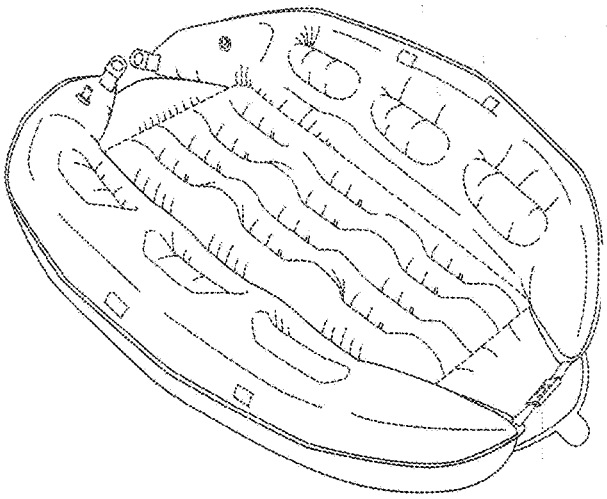
FIG. 11 depicts in perspective view a schematic of yet another representative embodiment of a device described herein when inflated and in a transitional configuration.
Figure 14:
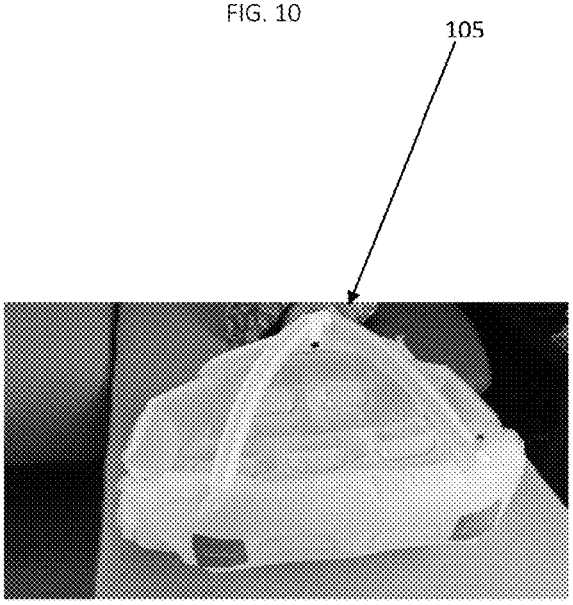
FIG. 14 depicts a side elevated view of the representative embodiment of FIG. 12.
Figure 12:
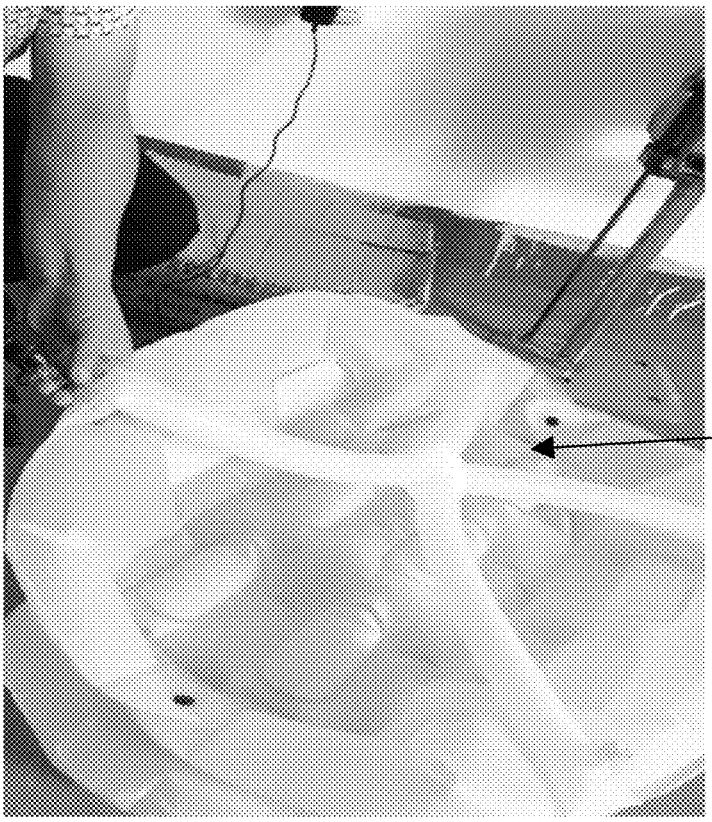
FIG. 12 depicts a top elevated view of still another representative embodiment of a device described herein showing an overhead element 105 or overhead companion 105 as described herein.
Figure 13:
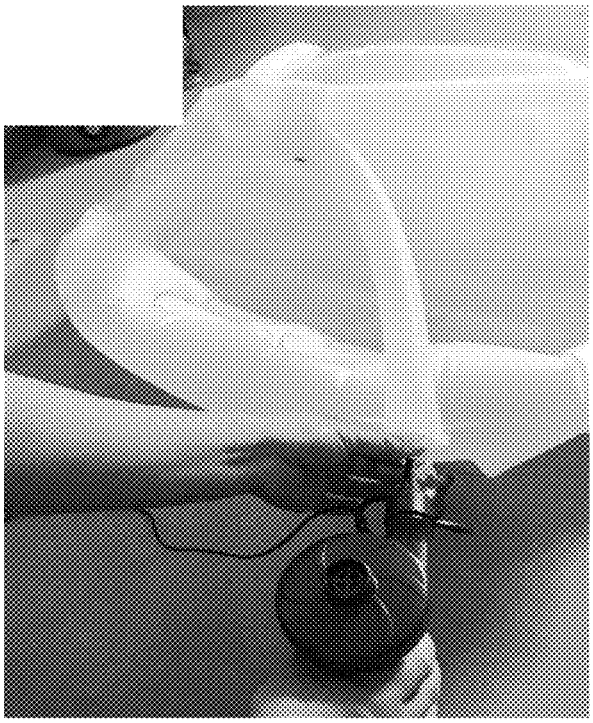
FIG. 13 depicts the representative embodiment of FIG. 12 along with a representative inflation device or means for inflation.
Figure 15:
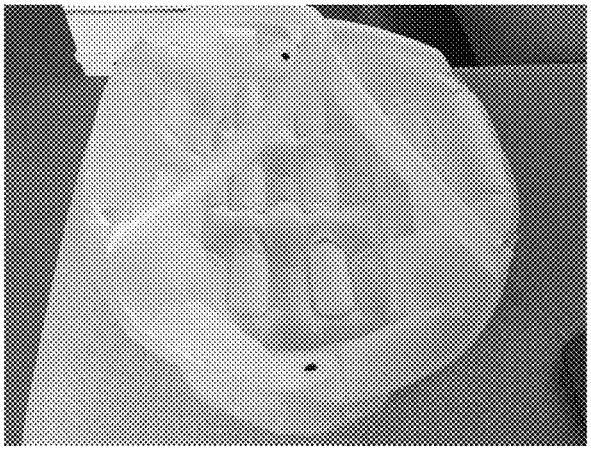
FIG. 15 depicts another side elevated view of the representative embodiment of FIG. 12.

In some embodiments, body 12 may further comprise one or more additional hinge regions. FIGS. 1A, 1B, and 2 further depict hinge region 22 positioned near a first end 23 of body 12, and hinge region 24 positioned near a second end 25 of body 12. Both, one, or neither of hinge regions 22 and 24 may be included. Body 12 may include a plurality of alternative and/or additional hinges and configurations thereof. In FIG. 1A, hinge regions 18 and 20 are depicted as linear. Hinge regions may also be curvilinear, arced, or in wave form, as non-limiting examples. In the embodiment of FIG. 1A, hinge regions 18 and 20 are also more centrally located with respect to the sides of body 12. In the embodiment of FIG. 1A, hinge region 18 includes only two ends 15*a*, 15*b*, each of which are adjacent gap 19*a* and 19*b*, respectively. Similarly, in FIG. 1A, hinge region 20 includes only two ends 17*a*, 17*b*, each of which are adjacent gap 19*c* and 19*d*, respectively. In the embodiment of FIG. 1B, the hinge region that is for partitioning wing 14 and body 12 includes an alternative configuration comprising hinge sections 18*a*, 18*b*, 18*c*, each of which has two ends 15*a*, 15*b*; however, end 15*a* of hinge section 18*a*, and end 15*b* of hinge section 18*c*, each extend to a sidewall or periphery of the device, shown as inner boundary 54, and are not adjacent any gap. And, while FIG. 1B, shows a similar sectioning of the hinge region partitioning wing 16 and body 12, provided as hinge sections 20*a*, 20*b*, 20*c*, the hinge regions adjacent the first and second sides of body 12 may mirror each other (e.g., shape, configuration, gap distance) or need not always mirror each other. Moreover, hinge sections need not have the same exact overall configuration or gap distance therebetween. Similarly, the hinge regions adjacent the first and second ends 23, 25, of body 12 (e.g., depicted as hinge region 22 and 24, respectively, in FIG. 1A), may mirror each other in shape, configuration and/or gap distance, or need not always mirror each other in their shape, configuration, and/or gap distance. However, as depicted in both FIGS. 1A and 1B, the hinge regions do not fully partition or separate body 12 with wings 14, 16. The gaps (e.g., two gaps, three gaps, or as needed) are provided to allow some continuity (e.g., internal continuity) between the body 12 and wings 14, 16.

Referring again to hinge region 22 (positioned near a first end 23 of body 12), and hinge region 24 (positioned near a second end 25 of body 12), such hinges, while shown, may or may not be included in all embodiments. When included, hinge regions 22, 24, may be linear, as depicted in the drawings, or arced, or curvilinear, or any other suitable shape, as desired. When included, hinge regions at ends 23, 25, of body 12, may help define a top surface of body 12 that may be used to support, hold, or otherwise engage a young child or infant. Hinge regions 22, 24, may help define a surface of body 12 that does not elevate when device 10, and body 12, and wings 14, 16, is inflated, as shown in the drawings, and further described herein.

Thus, it is understood that body 12, while depicted as having parallel oriented hinge regions 18 and 20, as well as parallel oriented hinge regions 22 and 24, such orientations are not necessary for the implementation of various embodiments of the device. In one or more embodiments, hinge regions adjacent sides (e.g., sides bounded by hinge regions 18, 20) of body 12 are coplanar. In one or more embodiments, hinge regions near ends of body 12 (e.g., first and second body ends 23, 25) are coplanar. In one or more embodiments, all hinge regions adjacent sides (e.g., sides bounded by hinge regions 18, 20) of body 12 are coplanar, and all hinge regions near ends (e.g., first and second body ends 23, 25) of body 12 are coplanar. In one or more embodiments, only hinge regions near ends (e.g., first and second body ends 23, 25) of body 12 are coplanar. In one or more embodiments, hinge regions adjacent sides (e.g., sides bounded by hinge regions 18, 20) of body 12 are curvilinear. In one or more embodiments, hinge regions adjacent sides of body 12 are parallel oriented. In one or more embodiments, hinge regions near ends of body 12 are parallel oriented. In one or more embodiments, hinge regions near ends of body 12 (e.g., first and second body ends 23, 25) are perpendicularly oriented with respect to hinge regions adjacent sides of body 12, or are relatively perpendicular, with respect to a line drawn through a point at each of first and second hinge ends [(15*a*, 15*b*, and 17*a*, 17*b*) of each of hinge regions 18, 20, respectively)].

Ends 23, 25, of body 12 are depicted in these figures as curvilinear in shape. It is understood that alternative shapes are possible, and may include a substantially linear shape, or comprise more than one linear section forming one or more angles.

In FIGS. 1-11, wings 14, 16, joined to body 12 by way of hinge regions 18, 20, respectively, are adjacent opposing sides of body 12. Each wing (14, 16) comprises at least one extending portion, depicted as 25 of wing 14, and depicted as 27 of wing 16. It is understood that the extending portions may or may not extend in the same manner, and may or may not comprise a same shape. Extensions 25 and 27 are depicted in FIGS. 1-11 may be curvilinear, or have at least one curvilinear portion, somewhat akin to an end of a banana. Alternative shapes may be utilized, and may comprise more than one curvilinear portion or one or more linear section, as depicted in, for example, FIGS. 17 and 18.

In one or more embodiments, such as depicted in FIGS. 1-11, the described device for supporting and/or holding the young child or infant generally comprises a device akin to, in whole or in part, an air or gas or water bladder having a unique and irregular form (non-polygonal), and including a top (with or having a top surface), a bottom (with or having a bottom surface), an outer edge on or adjacent a periphery (32, 52, 54), in which the outer edge may or may not further comprises a lip region (33), and a plurality of hinge regions (18, 20, 22, 24). In one or more embodiments, the described device for supporting and/or holding the young child or infant generally comprises a device comprising an air or gas or water bladder having a unique and irregular form (non-polygonal), the device including a top (with or having a top surface), a bottom (with or having a bottom surface), an outer edge (36) on an outer periphery, a plurality of hinge regions (18, 20, 22, 24), and the outer edge further comprising a lip region (33), in which the air or gas or water bladder is bounded by the top and the bottom, the device further comprising, at least in whole or in part, an inner periphery (32, 52, 54), a portion of which bounds an inner side of the lip. The hinge regions provide various moveable portions of the device. Said moveable portions typically further comprise a plurality of internal seams (28, 30), between which the top of the device and the bottom of the device may separate by air or gas or water (e.g., via the air or gas water bladder). Some of the hinge regions comprise double seaming (e.g., first and second seam sides and first and second seam ends, the seam sides or inner and outer seam providing a width, wider than, for example, a single seam or a single linear threaded seam, the double seaming forming or formed as a joined seam, or a welded seam, and/or seams formed with a plurality of layers or more than two layers). In one or more embodiments, all of the internal seams are double seams. In one or more embodiments, many of the internal seams are double seams. In one or more embodiments, a double seam is a fused or joined or welded seam. In one or more embodiments, a double seam is a not a threaded seam, which, when, for example, is a single linear threaded seam, may be considered a single seam. In one or more embodiments, a double seam is a heat seam. In one or more embodiments, some of the hinge regions comprise double seaming. In some embodiments, most of the hinge regions comprise double seaming. In one or more embodiments, all of the hinge regions comprise double seaming. Similarly, internal seams (28, 30, and in some embodiments, seams 26) may comprise double seaming (first and second seam, or inner and outer seam, e.g., first and second seam sides, and first and second seam ends, the seam sides and seam ends or inner and outer seams providing a width, the width wider than, for example, a single seam or a single linear threaded seam and/or at least twice as wide as a single seam, the double seaming forming or formed as a joined seam, or a welded seam; and/or a plurality of layers forming each seam). In some embodiments, most of the internal seams are double seams. In one or more embodiments, most of the internal seams are fused or welded seams. In one or more embodiments, most of the internal seams are fused or welded seams. In one or more embodiments, all of the internal seams are fused or welded seams. The hinge regions (each hinge region comprising one or more internal seams, and/or one or more fused or welded seams, and/or one or more seams comprising a plurality of layers) provide various moveable motions of the device.

Referring still to FIGS. 1-11, the device described herein may further comprise one or more projections (e.g., 40, 42, 44, 46). The one or more projections may include one or more enclosures, fasteners, or means for securing, enclosing, and/or fastening (e.g., securement or fastener, such as one or more of a clasp, belt, buckle, hook or loop, clip, lock, chain, zip, button or hole, pin or hoop, retaining ring, anchor, carabiner, and the like, as understood in the art, or as developed in the art for securing or fastening in a suitable manner appreciated by one of skill in the art). Alternative means for securing or fastening are depicted in FIGS. 17-21, 27, 28, 30, 31A-B, 31D, 31F, and 32A-B, as examples. The one or more projections may comprise a hold or a holding means (e.g., hold mechanism or element, such as one or more of a clasp, belt, buckle, hook and/or loop, clip, lock, chain, zip, button and/or hole, pin and/or hoop, retaining ring, anchor, carabiner, and the like, or on a clasp, belt, buckle, hook and/or loop, clip, lock, chain, zip, button and/or hole, pin and/or hoop, retaining ring, anchor, carabiner, and the like, as is understood in the art, or as developed in the art for holding when there is a securing or fastening, or when secured or fastened, in a suitable manner appreciated by one of skill in the art). The one or more projections may comprise a release or a releasing means (e.g., release mechanism or element, such as one or more of a clasp, belt, buckle, hook and/or loop, clip, lock, chain, zip, button and/or hole, pin and/or hoop, retaining ring, anchor, carabiner, and the like, or on a clasp, belt, buckle, hook and/or loop, clip, lock, chain, zip, button and/or hole, pin and/or hoop, retaining ring, anchor, carabiner, and the like, as is understood in the art, or as developed in the art for releasing when there is a securing or fastening, or when secured or fastened, in a suitable manner appreciated by one of skill in the art). In some embodiments, certain projections may be inflatable (e.g., FIGS. 12-16). In some embodiments, few if any of the projections are inflatable.

Figure 26:
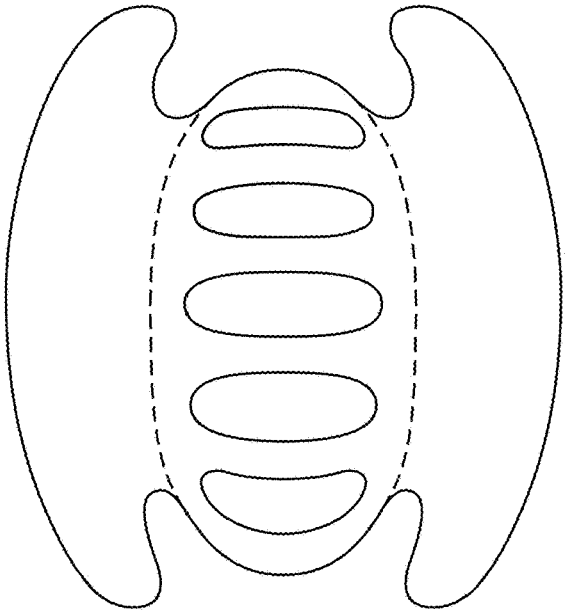
Figure 27:
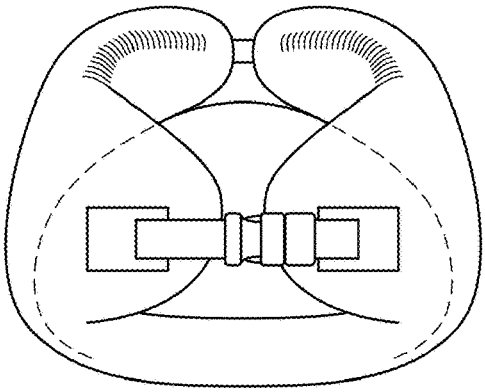

In the embodiments described herein, each of the body, the first wing, and the second wing comprise at least one peripheral seam, one or more hinge regions, and one or a plurality of interior (internal) seams. Generally, each seam provides a region or location at which there is a physical joining of the described device. Generally, in one or more embodiments, each peripheral seam and one or more or a plurality of hinge regions, such as hinge regions 18, 20, 22, 24, provides a region or location at which there is a physical joining of the top of the device and the bottom of the described device. The interior (internal) seams (26, 28, 30) may be of irregular shapes (e.g., as depicted in FIG. 26), an oval shape (e.g., as depicted in FIGS. 1-11), a linear shape (e.g., as depicted in FIGS. 17-21). Of course, alternative embodiments are readily contemplated as may be provided by one of skill in the art. In one or more embodiments, the interior (internal) seams are disposed with some regularity (e.g., similar shape and/or uniform spacing between at least some or all of the interior seams). In some embodiments, the interior (internal) seams are oriented uniformly. In some embodiments, the interior (internal) seams (28) are oriented uniformly in the first wing 14, and the interior (internal) seams (30) are oriented uniformly in the second wing 16, and the interior (internal) seams (26) are oriented uniformly in the body 12. In some embodiments, each of the interior (internal) seams are disposed away from the peripheral seam (e.g., have a gap between an end of the internal seam and a peripheral seam). In some embodiments, at least some or all of the interior (internal) seams are evenly (regularly) disposed, and are formed away from the peripheral seam. In one or more embodiments, at least some or all of the interior seams provides a physical joining of the air or gas or water bladder.

In some embodiments, the hinge regions between the body and the wings do not allow air flow between the body and the wings, when inflated. In some embodiments, as depicted in FIG. 1A, the hinge regions between the body and the wings (18, 20) allow air flow between the body and the wings, when inflated. In some embodiments, the hinge regions do no reach the periphery of the device (interior periphery 32, outer edge 36). Instead, gaps 19*a*, 19*b*, 19*c*, 19*d*, are formed, allowing air flow between the body and wings of the device, when inflated.

In some embodiments, as depicted in FIG. 1A, the internal seam (e.g., 28, or 30, which may be one seam, or two seams, or seams formed with two or more or a plurality of layers, or more than two internal seams, and may be a double seam as described herein) includes at least one gap (e.g., one or both of 28*a* and/or 28*b*), to allow air flow, such as into an interior space 58 (when there is one formed by the overall shape of the internal seam 28), or between the two or more than two internal seams.

In one or more embodiments, there is at least one peripheral (outer) seam of the device 10. The at least one peripheral (outer) seam may comprise a lip region, as depicted in FIGS. 1-24, 33-34, and 37-51, or no lip, as depicted in FIGS. 25A, 25B, and 26-30. The at least one peripheral (outer) seam may be formed by the lip region 33 (e.g., FIG. 1A), as further depicted in FIGS. 1-24, 33-34, and 37-51. In FIGS. 1-11, for example, the lip (lip region) is not necessarily uniform around the periphery of the device.

In any of the embodiments described herein, the at least one peripheral seam (with or without the lip region) forms an outer edge 36 of the device, such as in FIG. 1A, at which there is a physical joining of the top of the described device, and the bottom of the described device. In some embodiments, the outer edge, and in some embodiments, the hinge regions and/or the internal seams, provide locations at which the top of the device and the bottom of the device remain in physical contact and/or in location, even when the device is inflated by a means of inflating the device (e.g., by mouth, by an inflator, by a pump, as examples). The outer edge as well as the hinge regions are generally seamed, and/or welded or fused or otherwise integrated. Said outer edge, in combination with one or more internal seams, will help prevent overall slip or movement or displacement of the device (e.g., with respect to its top and bottom), as well as to prevent overall slip or movement or displacement of the bladder, especially when inflated (e.g., slip or movement or displacement of the bladder with respect to the top and the bottom of the device). In one or more embodiments, the outer edge as well as the hinge regions, and, in some embodiments, the internal seams of the device, provide locations at which portions of the top of the device and portions the bottom of the device, as well as the bladder, remain in precise locations, when the device is deflated, and even when the device is inflated by a means of inflating the device (e.g., by mouth, by an inflator, by a pump, as examples). In one or more embodiments, the internal seams of the device provide locations at which portions (e.g., layers) of the bladder remain in physical contact, and locations at which portions of the top and bottom of the device are fused or otherwise integrated with portions of the bladder, even when the device is inflated by a means of inflating the device (e.g., by mouth, by an inflator, by a pump, as examples).

With hinge regions of any device described herein, the hinges partition the first wing and the second wing from the body, and allow for the first wing, and the second wing, to be displaced from a same plane as the body of the device. In this manner, the described device is designed to hold a number of configurations, including at least a first configuration, in which the described device is considered deflated (e.g., body, first wing, and second wing, are all in a same plane). This also includes a second configuration, in which the described device is inflated. The second configuration may comprise a host of alternative configurations, in which regions of the top of the device and regions of the bottom of the device are spaced apart, thereby having a gap therebetween, some or all of which is filled by air or gas or liquid (excluding the at least one peripheral (outer) seam or outer edge, and the hinge regions, and/or the internal seams), and/or in which regions of the top of the device and the bottom of the device are not in physical contact.

Any device described device is further designed to hold at least a third configuration, in which the described device is further shaped, by securing at least one or more securing means (e.g., securement or fastening elements 40, 42, as depicted in FIG. 1A) associated with the device. In the third configuration, which may be obtained by being transitioned from the first configuration, or may be obtained by transitioning from the second configuration, one or both hinge regions of the device provide movement of the device, so that one or both wings of the device are no longer in a same plane as the body of the device. Thus, portions of the bottom of the device (e.g., at the hinge regions) allow the wings to become elevated or angled with respect to the bottom surface of the device (or with respect to a supporting surface or floor or ground on which the device is positioned on). In the third position, at least one wing is disposed away from the supporting surface, or is elevated off of the supporting surface, such as the floor or the ground. In the third position, all or portions of both the first and second wing are disposed away from the supporting surface, or is elevated off of the supporting surface, such as the floor or the ground.

Figure 31A:
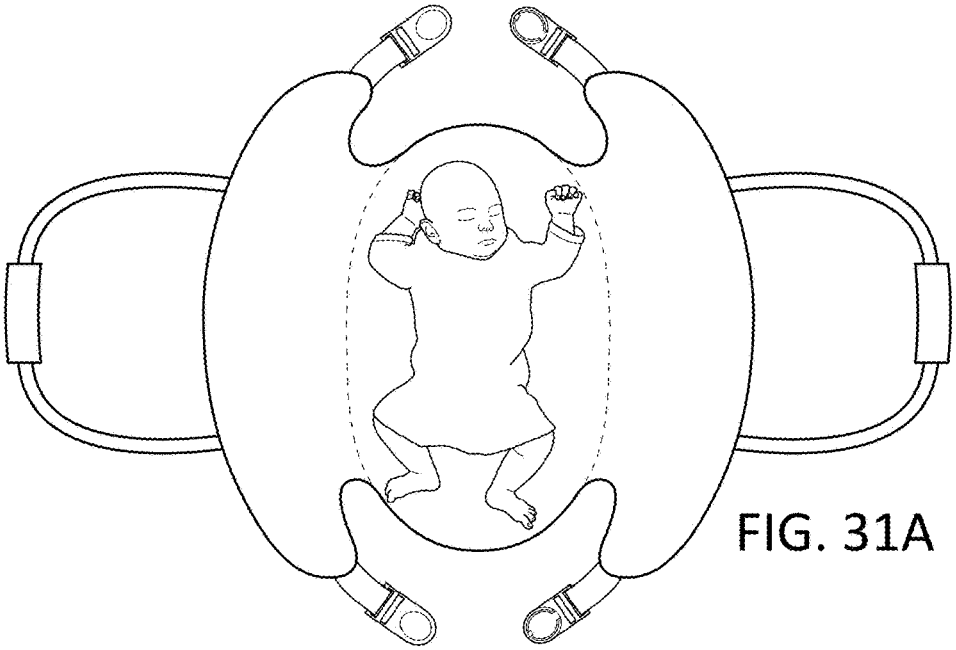
FIGS. 31A-F illustrate, in schematic form, additional various embodiments and associated accessories of a device described herein, including various representative uses of a device described herein.
Figure 31B:
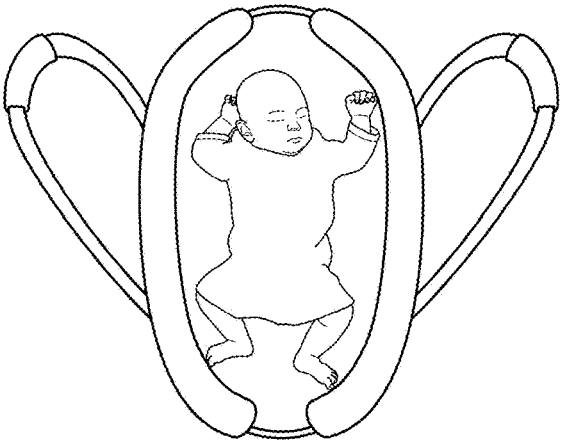
Figure 31C:
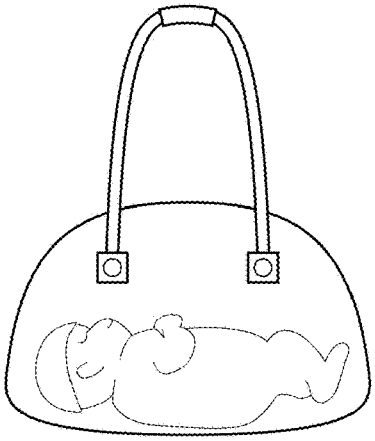
Figure 31D:
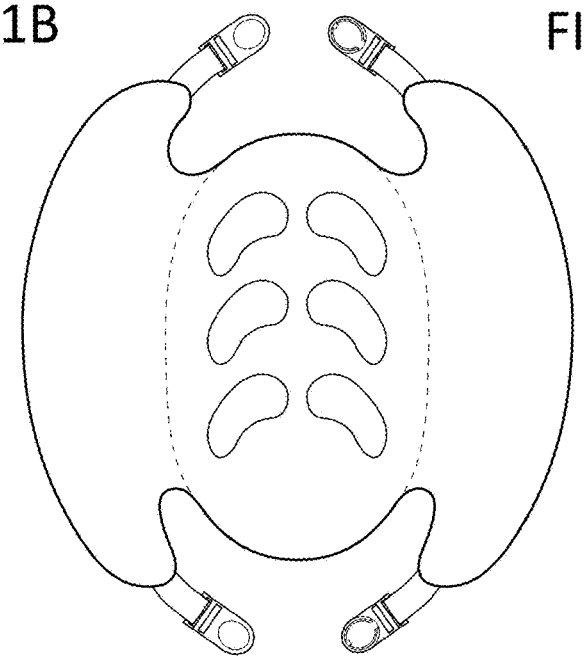
Figure 31E:
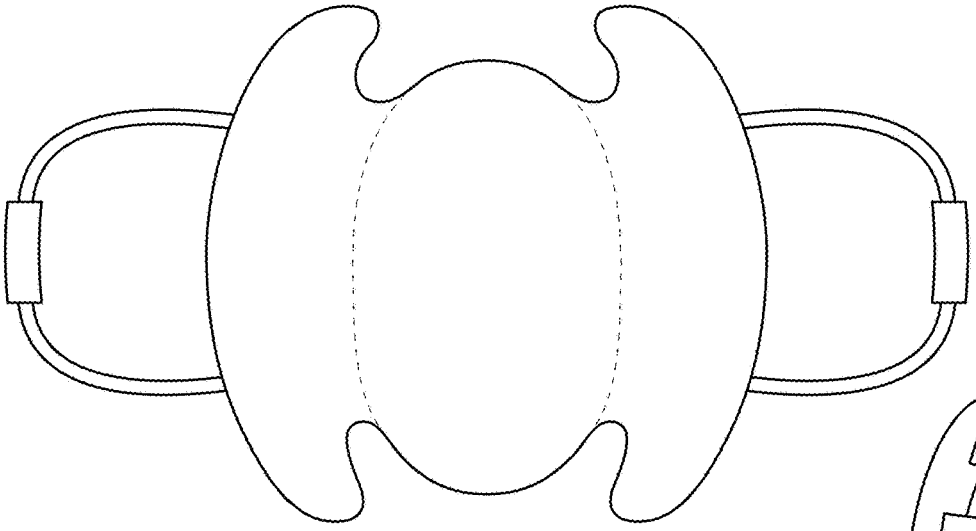
Figure 31F:
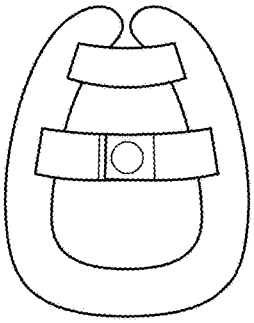
Figure 32A:
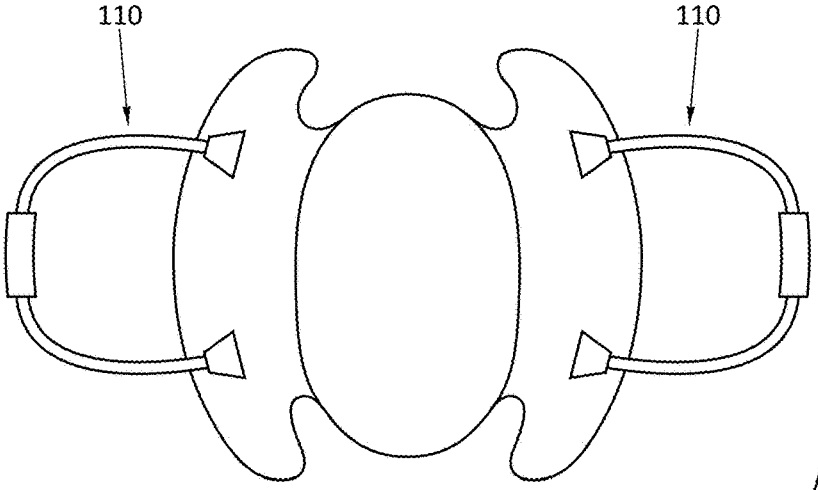
FIGS. 32A-B illustrate, in schematic form, further various embodiments of a device described herein, including use of a device described herein.
Figure 32B:
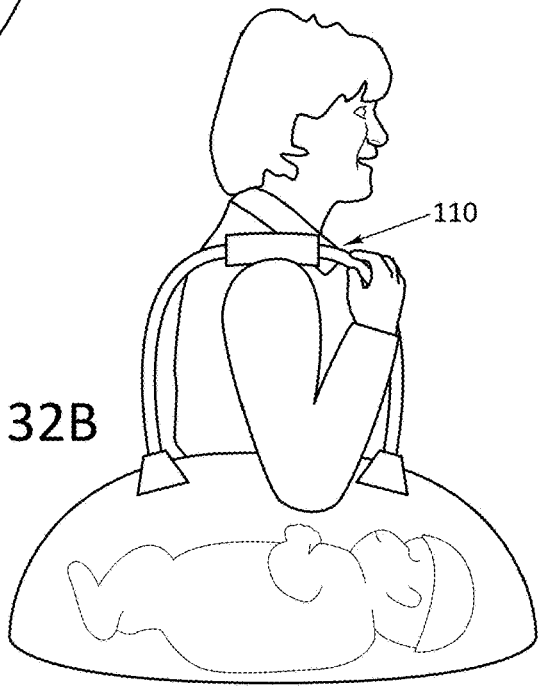

Still further, any device described herein is further designed to hold at least one or a plurality of fourth configurations, in which the described device is deflated and at least a portion of the device is folded, such as depicted in FIG. 31C and 31F. In some embodiments, it is contemplated that the third configuration may be obtained by transitioning from the fourth configuration.

Figure 17:
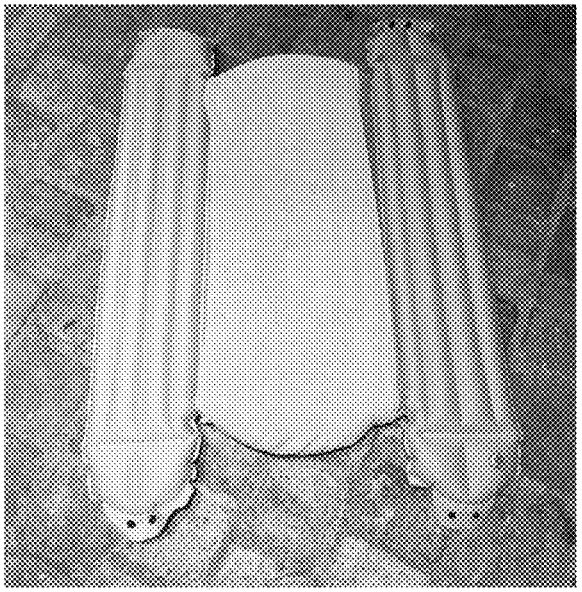
FIG. 17 depicts still a further representative embodiment of a device described herein.
Figure 18:
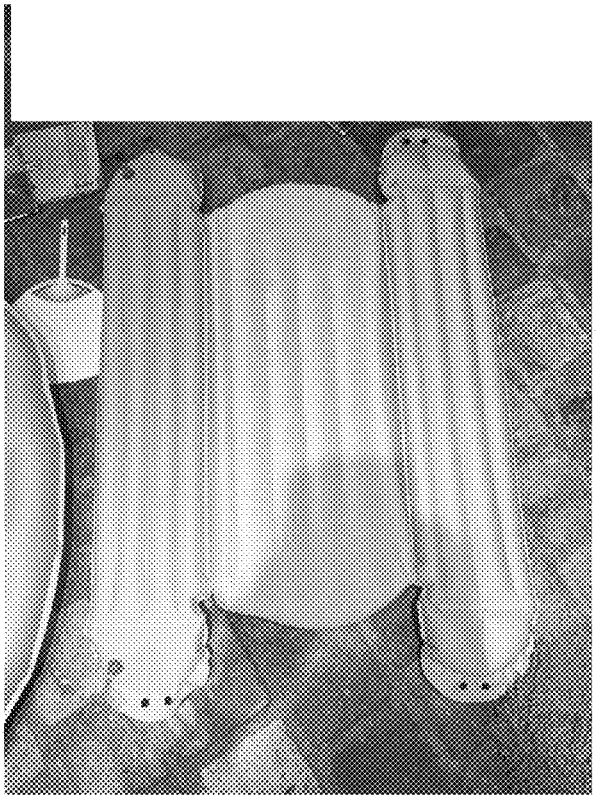
FIG. 18 depicts a top view of the described device of FIG. 17.
Figure 19:
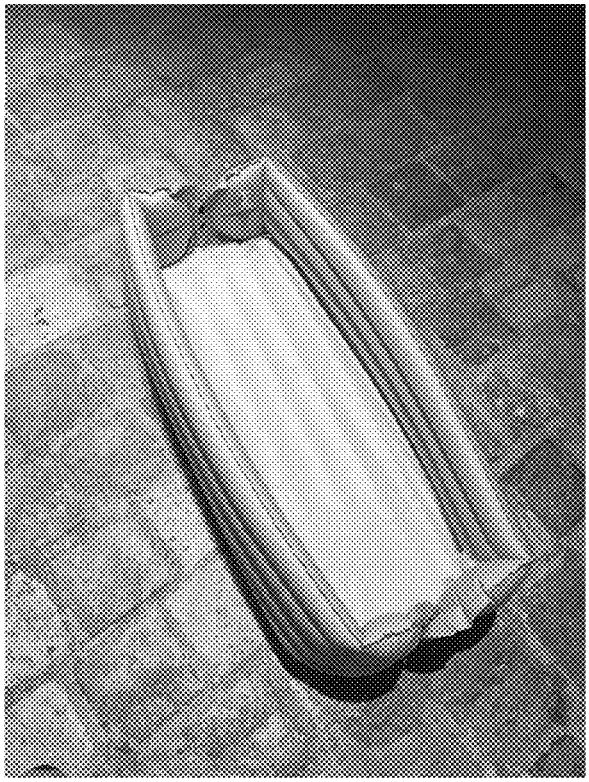
FIG. 19 depicts a perspective view of the described device of FIG. 17 when in an alternative position or closed configuration.

In use, any device described herein is generally or may be inflated when in an open (unfolded) arrangement (see, e.g., FIG. 17, 18). However, it is contemplated that the described device may be inflated from a folded arrangement. The device is inflated via an inlet, which may be positioned anywhere on the device (see, e.g., inlet 38, FIG. 1A). In one or more embodiments, the inlet is positioned on the bottom of the device. In one or more embodiments, the inlet is positioned on at least one wing of the device, often on the bottom of the wing of the device, and/or may be positioned on both wings of the device. The inlet may have one or more positions. For example, the inlet may have a first position for inflation or for promoting inflation, and a second position for deflation or for promoting deflation. Any means for inflating the device is contemplated. In one or more embodiments, the means for inflation is a pump. In one or more embodiments, the means for inflation is a micropump, one that may be permanently or temporarily associated with the device. Suitable examples of micropumps are manufactured and/or provided by Xavitech AB (Sweden), Bartels Microtechnik GmbH (Germany), Servoflo (U.S.), TCS Micropumps LTD (England), and the like. When a micropump is associated with the device, it may be positioned in a pocket formed directly on or as part of the device, or formed on a cover for the device.

In an example for use of the device, the device is unfolded (partially or fully), and all or a portion of the bottom of the device is positioned on a supporting surface (e.g., floor or ground). The device is inflated by a means for inflating (e.g., inflator, pump, injector), by allowing air, gas, or liquid to enter through an inlet into the device via the means for inflating. In one or more embodiments, the device is inflated without positioning on a supporting surface. Once the device is inflated to a desired degree, the means for inflating ceases operation, and/or is dissociated or removed from the inlet, and the inlet is closed. The device is then further secured in a manner that ensures that at least a portion of the bottom of the device is disposed or elevated away from the supporting surface. This generally includes having at least a portion of the bottom of one or both of the wings disposed or elevated away from the supporting surface, while having most or a majority of the bottom of the body remaining on the supporting surface (when the device is positioned on a supporting surface). For travel, both wings, when inflated, are disposed away from the plane of the body of the device (no longer in a same plane or coplanar with the body of the device).

In one or more embodiments, all or a portion of the body may be encased by a cover. In one or more embodiments, all or a portion of the body and all or a portion of the wings may be encased by a cover. In one or more embodiments, the device or at least a portion of the device is encased or coated by a cover. In one or more embodiments, the device or at least a portion of the device is encased or coated by a cover, which is removable (e.g., a cover, or a further cover, as described below). In one or more embodiments, the cover may be a layer on at least the body. In some embodiments, this layer may be on the body and the wings. In one or more embodiments, this layer is adhered to at least a portion of the body of the device. In one or more embodiments, this layer is adhered to at least a portion of the body and to at least a portion of the wings of the device. In one or more embodiments, the layer is adhered permanently (e.g., at the outer edge, lip, and/or hinge regions).

In addition, or as an alternative, the cover may be provided as a further layer on at least the top of the body. In addition, or as an alternative, the cover may be provided as a further layer on at least the body and all or a portion of the wings. In addition, or as an alternative, the cover may be provided on most of or on the entirety of the device. In some embodiments, this further layer is removable. In some embodiments, this further layer is, itself, sewn or otherwise joined (e.g., forming the cover). In some embodiments, this further layer is removable. In some embodiments, this further layer includes one or more openings, allowing for access to one or more projections of the device. In some embodiments, this further layer is sewn on. In one or more embodiments, in addition, or as an alternative, the further layer is adhered on (permanently, or removably).

Figure 54:
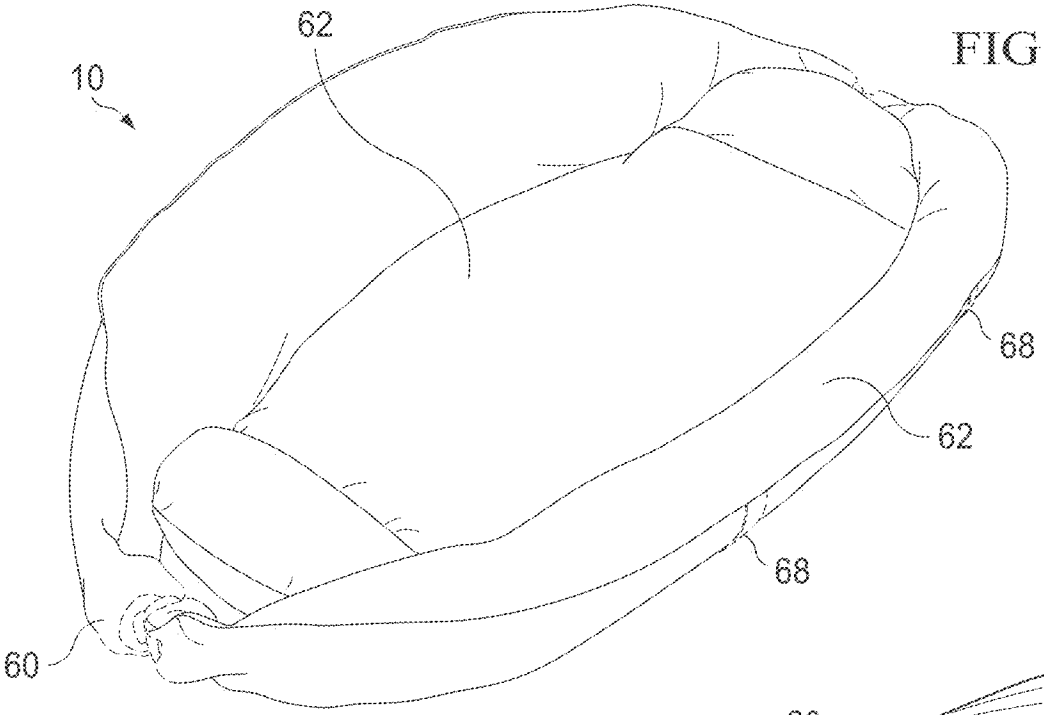

The cover may be designed for and suitable for the entire device (e.g., FIG. 54, 55). The cover may be designed for and only sufficient for the body of the device (see, e.g., FIGS. 17-20). In some embodiments, more than one cover may be provided, such as a first cover for the body of the device (see, e.g., FIGS. 17-20), and second cover for the entirety of the device, such as when the device is at least partially or fully inflated. In one or more embodiments, more than one cover may be provided, such as a first cover for the entirety of the device, and second cover for most of the device or for generally the entirety of the device. In one or more embodiments, the more than one cover, such as the first cover and the second cover, both allow for movement of the device (e.g., for inflation, for deflation, for folding).

Figure 20:
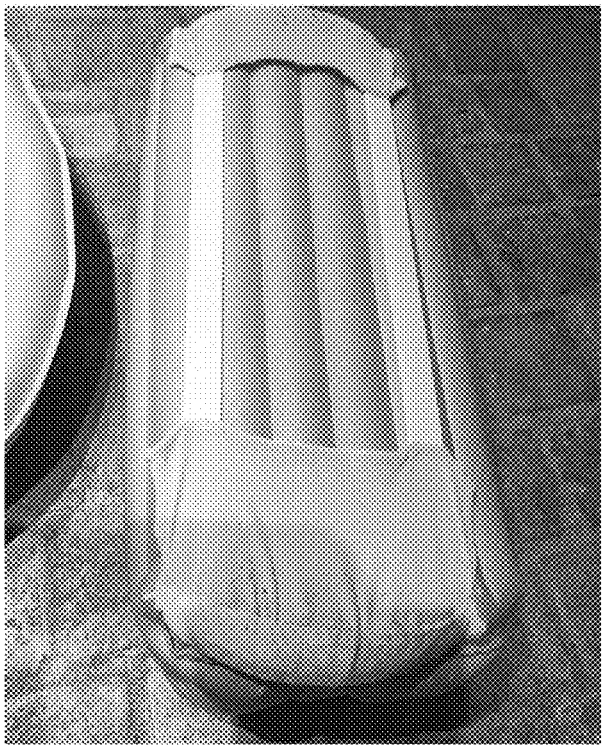
FIG. 20 depicts a bottom view of the described device of FIG. 19.
Figure 21:
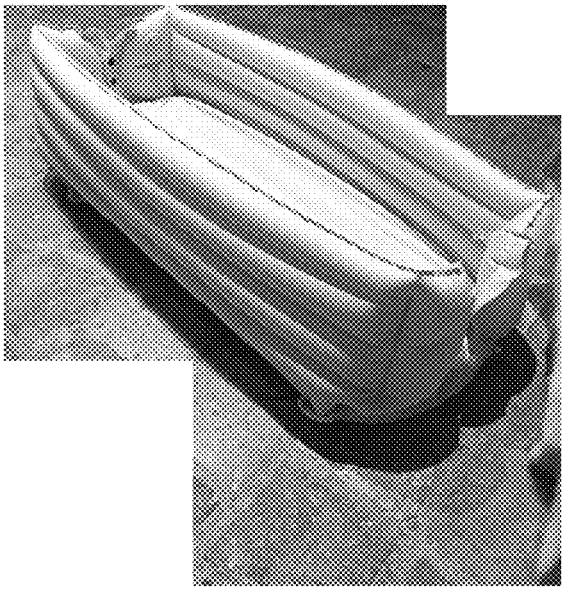
FIG. 21 depicts an alternative perspective view of the described device of FIG. 17 when in the alternative position or closed configuration, as in FIG. 19
Figure 22:
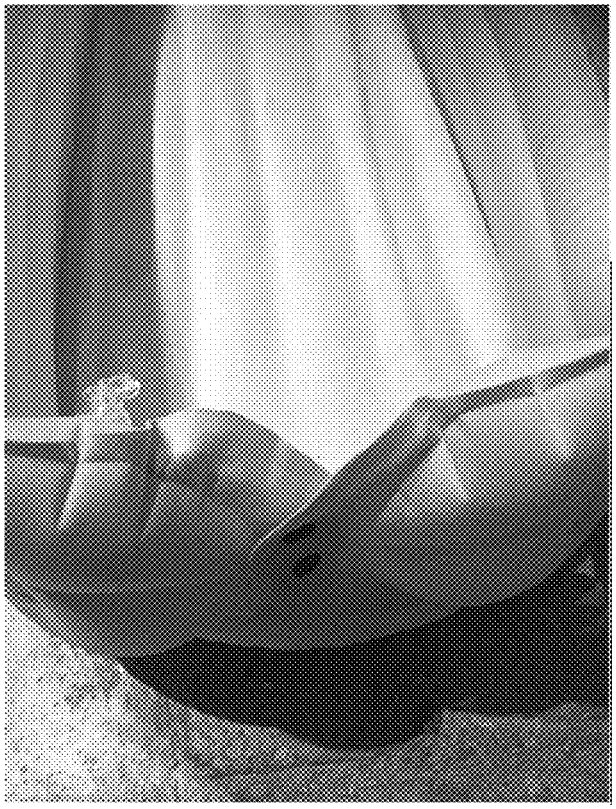
FIG. 22 depicts a close-up of an end view of the described device of FIG. 21.
Figure 52:
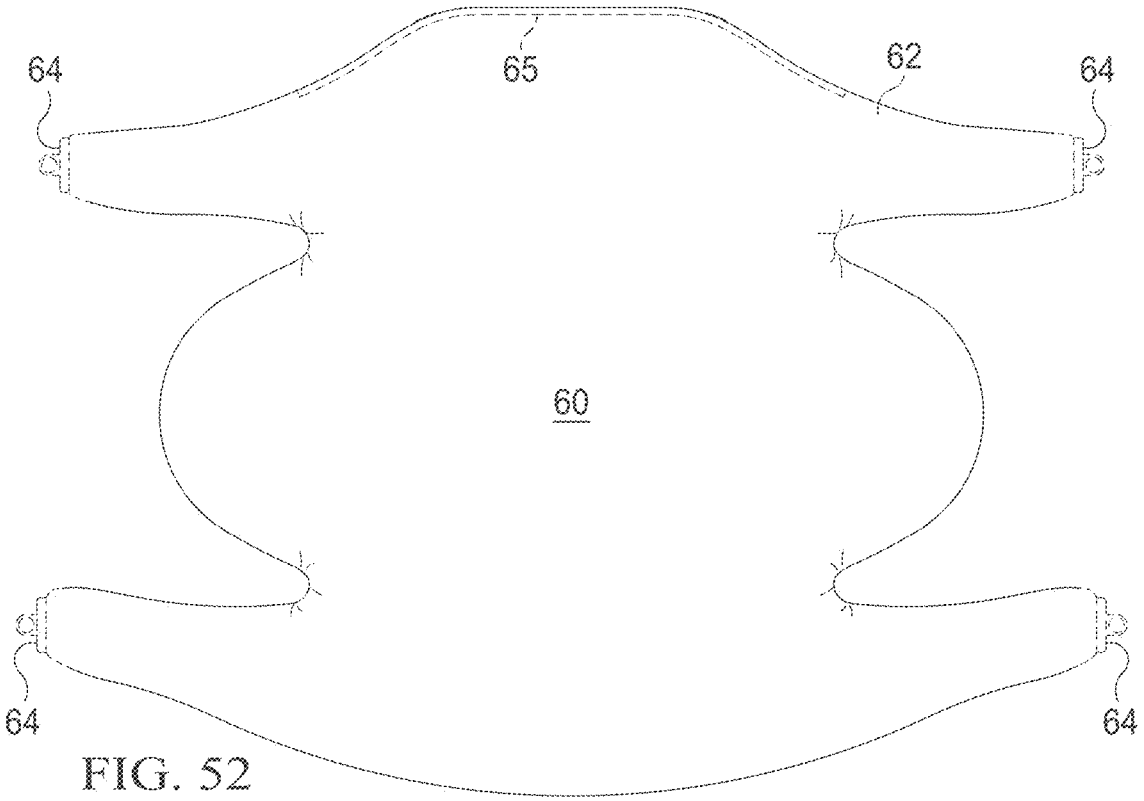
Figure 53:
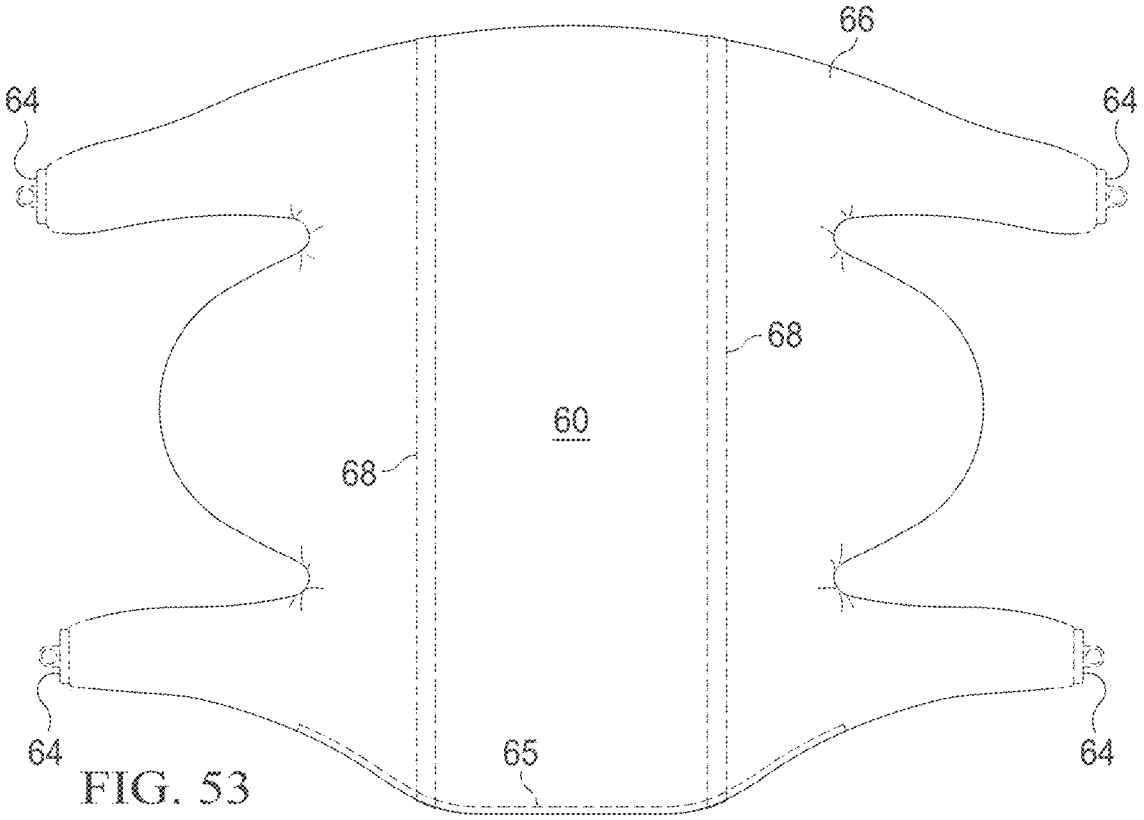

The cover may be designed to encase or coat or surround the body and not the wings of the device. For example, the cover may be designed to encase or coat the top of the body, while not encasing or only partially encasing or coating the bottom of the body, as depicted in FIG. 20. In one or more of the embodiments, at least one cover is removable. An example is the cover of FIGS. 35 and 36 (showing top and bottom, respectively), designed for removal from the device of FIGS. 33 and 34 (showing top and bottom, respectively). In another example, such as in FIG. 10, the device is shown to include a further cover on top of the body of the device, that only further covers a portion of the bottom of the body of the device. This type of cover (e.g., of FIG. 10 or of FIGS. 35-36) may comprise clasps, straps, or other fastening means (e.g., zippers, and the like, such as shown in the top region of the photograph of FIG. 35, which, in reference to securement 65 of FIGS. 52 and 53, is on a wing side of the cover of the device), and/or may fit on top of and/or fittingly around a portion of or with all of the device, the latter of which is shown in FIGS. 35-36, in which the cover shown includes a plurality of regions that cover the wings of the device, each looking like a sleeve and that further show elastic or cuff-like regions at its end. The cover may include or further comprise additional means that keep the cover on top of and/or fittingly with or in contact with all or a portion of the device, such as clasps, straps, or other fastening means, and any combination thereof.

In one or more embodiments, any device described herein, or at least a portion of said device, is encased or coated by a cover. In one or more embodiments, the device or at least a portion of the device is encased or coated by a cover (e.g., further cover), which is removable. Such a cover may encase or coat some, or most, or all of the device. Such a cover may be formed in a same or similar shape as the device. Such a cover may include one or more fasteners, clasps, straps, zippers, sleeves, cuffs, and the like to prevent dislocation of the cover. The one or more fasteners may include one or more enclosures, or means for securing, enclosing, and/or fastening the cover (e.g., securement or fastener, such as one or more of a moveable and/or reversible closure mechanism, such as clasp, belt, buckle, hook or loop, clip, lock, chain, zip, zipper, button or hole, pin or hoop, retaining ring, anchor, carabiner, and the like, as understood in the art, or as developed in the art for securing or fastening in a moveable and/or reversible opening and closing means, in a suitable manner appreciated by one of skill in the art). To further prevent dislocation of the cover, the cover may be secured to the device. To further prevent dislocation of the cover, the cover may be configured in the same shape as the device, or in the same shape of the portion of the device it is to encase or coat. The cover may be configured in the same general shape as the device, or in the same shape and size of one or more portions of the device it is to encase or coat when the device is inflated. The cover may be configured to fittingly encase or coat the device when the device is in its inflated (e.g., fully inflated) position. The cover may be washable. The cover may be provided by a material that can be readily cleaned. The cover may be resistant to stains and/or water. The cover is typically provided by a hygienic material when it serves as an outer surface of the device. In one or more embodiments, at least one cover is included with a device, on at least an upper surface of the body of the device (e.g., the surface that will be facing the child or infant), for safety purposes, and/or to prevent a child or infant from injury.

In one or more embodiments, a material used for forming the device (e.g., body and wings comprising the bladder, one or more covers) is a thermoplastic material (e.g., capable of molding, and/or being heated and welded, for forming hinges and one or more seams [contacting seams] of the device). In one or more embodiments, the material used for forming the device (e.g., body and wings comprising the bladder, one or more covers) is a thermoplastic urethane or a thermoplastic polyurethane. In one or more embodiments, the material used for forming the device (e.g., body and wings comprising the bladder, one or more covers) is the same. In addition, or as an alternative, any cover of the device or portion of the cover of the device may be configured, on its surface (e.g., bottom surface, top surface, portions thereof) with an additional material (e.g., one or more strips of the additional material). When the additional material is on the bottom surface, it may be provided to prevent slip of the bottom surface of the device (or prevent unwanted movement of the device) with respect to a supporting surface on which the bottom surface is in contact with. When the additional material is on a top surface, it may be provided to prevent slip (or unwanted movement) of the child or infant with respect to the top surface on which the child or infant is in contact with. When said additional material is provided to prevent slippage or to prevent unwanted movement, it may be a so-called friction fabric, or friction material (e.g., have a higher coefficient of friction than the top surface, or cover, of the device). The additional material may be a non-slip material. The additional material may simply reduce slip, as compared with slip associated with the top surface, or cover, of the device (e.g., material used for forming the device).

Figure 16:
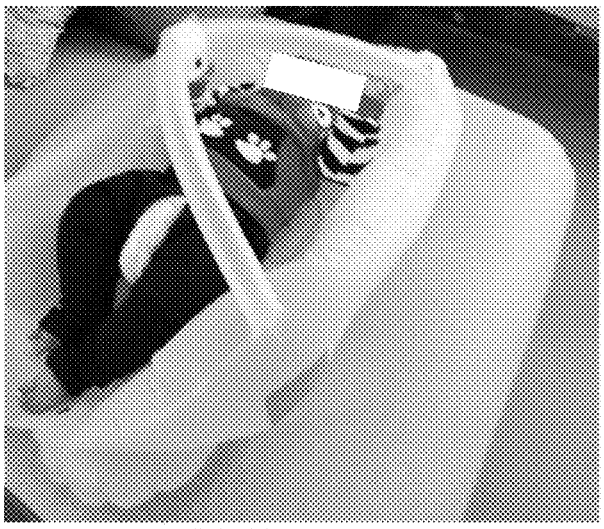
FIG. 16 depicts the representative embodiment of FIG. 12 supporting a child or infant.
Figure 30:
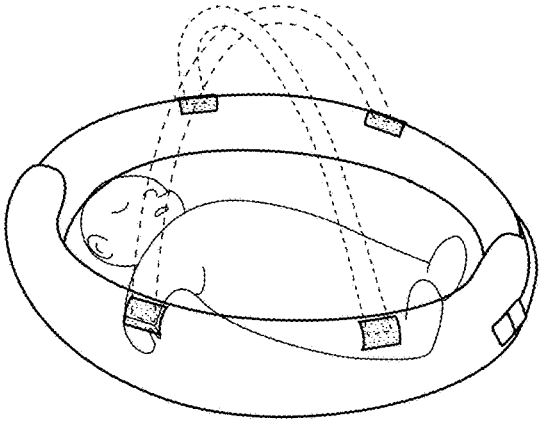
Figure 29:
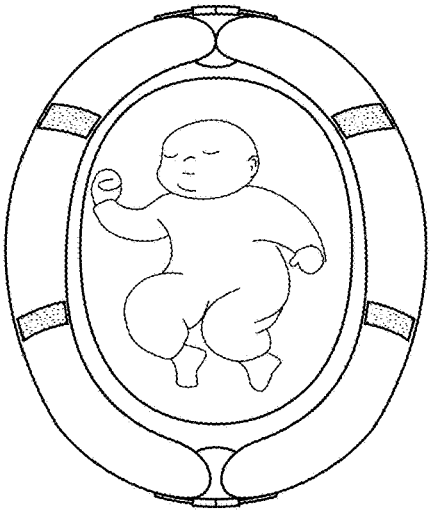

FIGS. 16, 29, and 30 illustrate various uses of the device. FIGS. 31A-F and 32A-B illustrate various uses, or additional uses, of the device. For example, in one embodiment, and referencing FIGS. 31A-F, the described device may be inflated, as in FIG. 31A, and the inflated device is further enveloped by a cover that envelopes the wings and the body of the device. The cover may include fastening means, or the cover may include holes through with fastening means of the device pass through in order to further secure the device. In FIG. 31A, a child or infant, as depicted in the drawing, is positioned so that it is in contact with the cover (and is not in direct contact with the top surface of the body of the device). When positioned on the device, the child or infant is positioned on the body portion of the device, and is not positioned on either of the wings of the device. As depicted in FIG. 31B, wings (e.g., each wing) of the device are fully secured by a fastening means (either attached directly to the cover, or attached directly to the device, and available via through-holes suitably positioned on the cover). With full securement and fastening of the fastening means, the child or infant is held within the device, as depicted in FIG. 31B (e.g., resting on a top surface on an outer [further] cover of the body of the device, and encircled by wings of the device). FIG. 31C shows the cover further configured with two handles 110, suitably positioned near edges of the wings, so that the handles 110, when they meet, may be used to hold the child or infant within the device, and/or may be used to travel with the child or infant while the child or infant is securely, safely held within (e.g., encircled by) the described device. This is further depicted in FIGS. 32A-B.

FIG. 31D shows an embodiment of a bladder of the described device, in which only the body of the bladder of the device has air or gas or water cells (e.g., see kidney-shaped cells formed by one or more seams having one or more gaps therein), in which the bladder does not have an outer cover, or only the body of the bladder of the device has or is partially or wholly enveloped or protected by a cover. In this embodiment, fastening means are directly attached to the wings of the body of the bladder of the device.

FIG. 31E shows an embodiment in which the entirety of the top surface of the device has a cover. The bottom surface (not shown) may be wholly enveloped or may be partially protected or shielded by the cover. The cover may be integral with the device (welded and/or otherwise adhered to at least portions of the device (e.g., outer edge, hinge regions).

Figure 24:
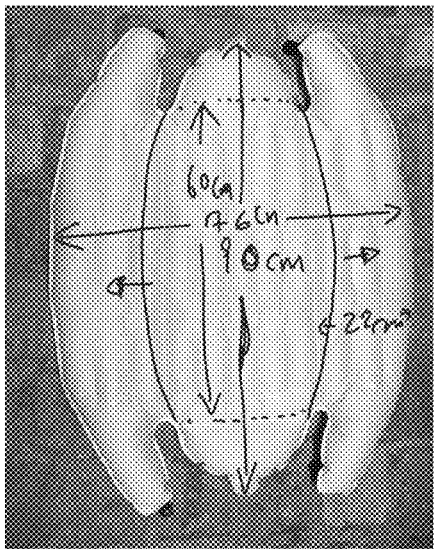
FIG. 24 depicts representative dimensions of a representative prototype of FIG. 23A, when in an open and inflated position.
Figures 23A, 23B:
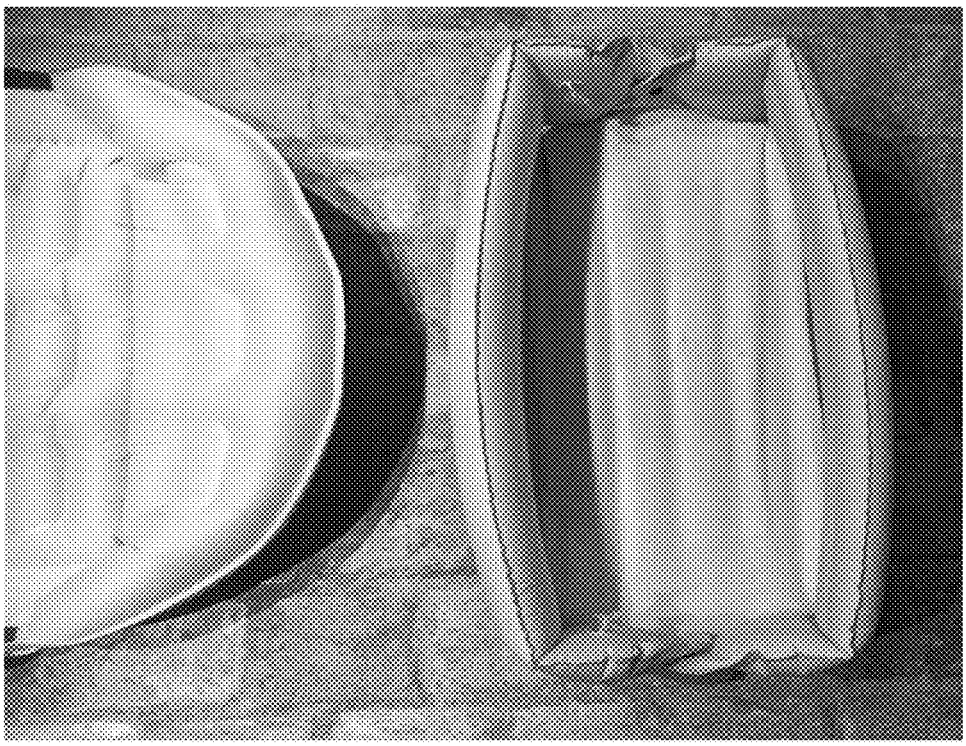
FIG. 23A depicts a partial view of a representative prototype of the described device of FIG. 11.
FIG. 23B depicts a top view of another representative prototype as depicted in FIGS. 17-22.
Figure 25A:
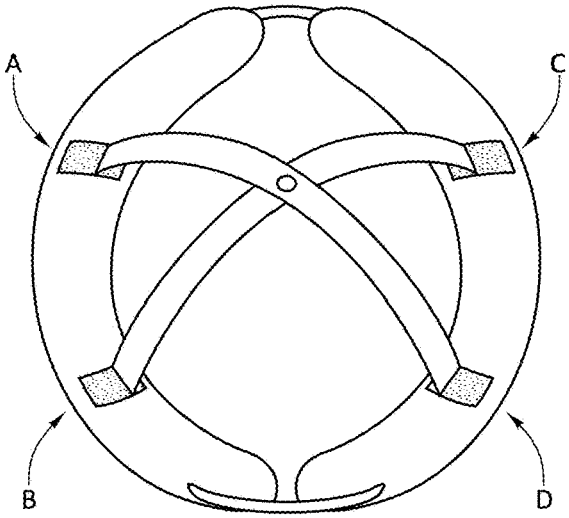
FIGS. 25A, 25B, and 26-30 depict various views and accessories associated with still further representative embodiments of a device described herein.
Figure 25B:
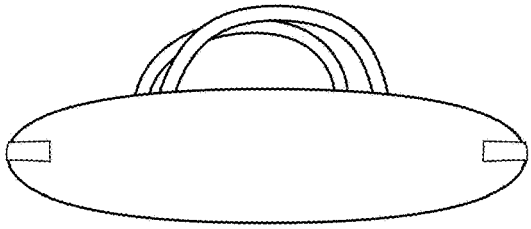
Figure 28:
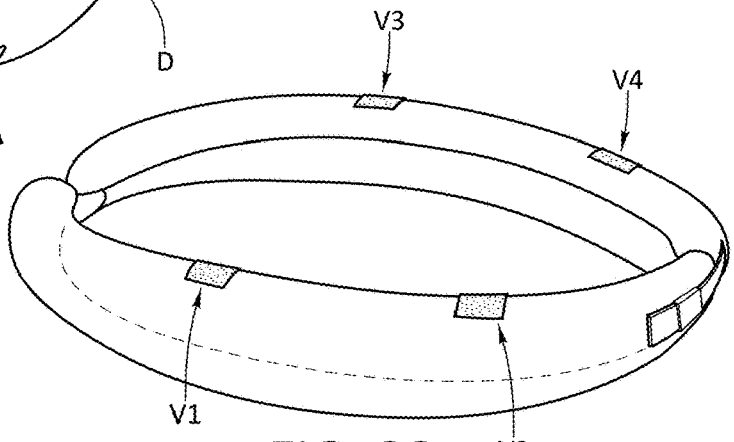

FIG. 24 illustrates representative measurement of a device described herein, in which the device, such as one depicted in FIG. 1A is shown, when inflated but without fastening the wings. In this embodiment, a length of the device, in a first dimension, is about 90 cm, a width of the device, in a second dimension, is about 76 cm. Each wing has a width, in the second dimension, of about 22 cm. Of course, alternative sizes for various stages of growth of an infant or child are contemplated. The carrying capacity of such a device is dependent on the materials chosen, as would be understood in the art. In one or more embodiments, the device with a carrying case or bag is from about 1 to about 3 pounds, or from about 2 to about 4 pounds, or from about 3 to about 5 pounds, or from about 4 to about 6 pounds, or any combinations thereof.

Figure 33:
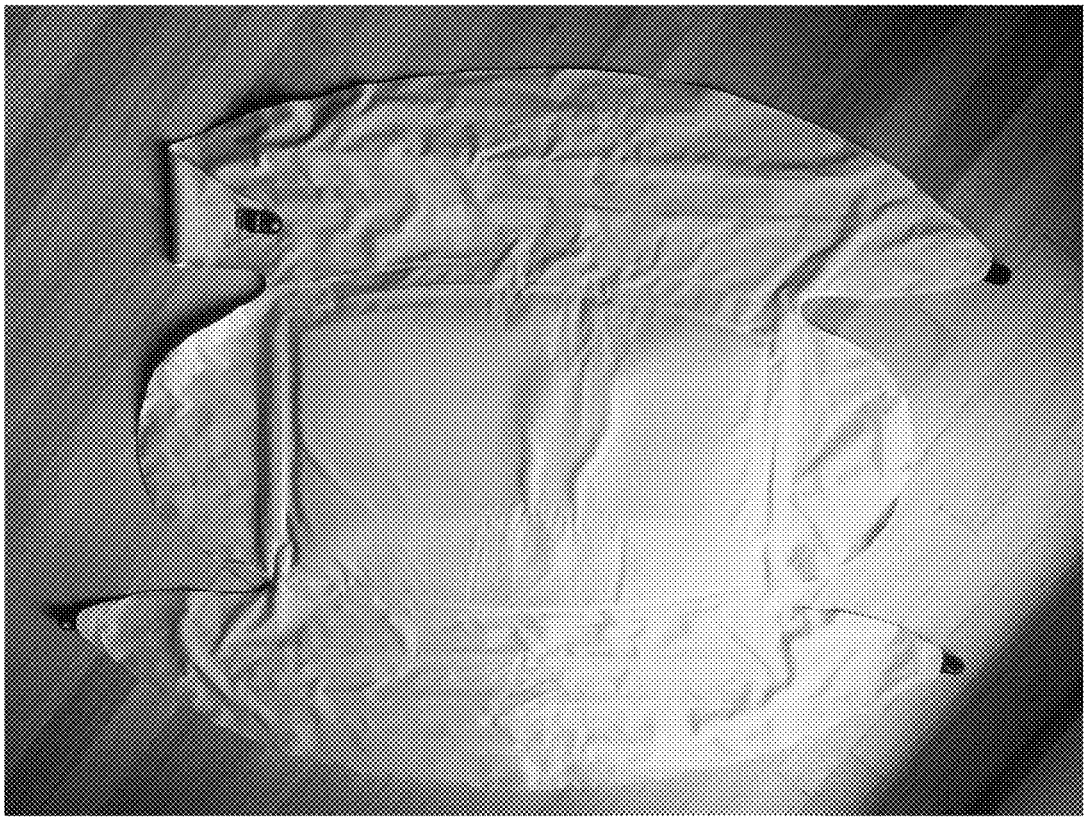
FIG. 33 illustrates a top view of yet a further representative embodiment and prototype of a device described herein.
Figure 34:
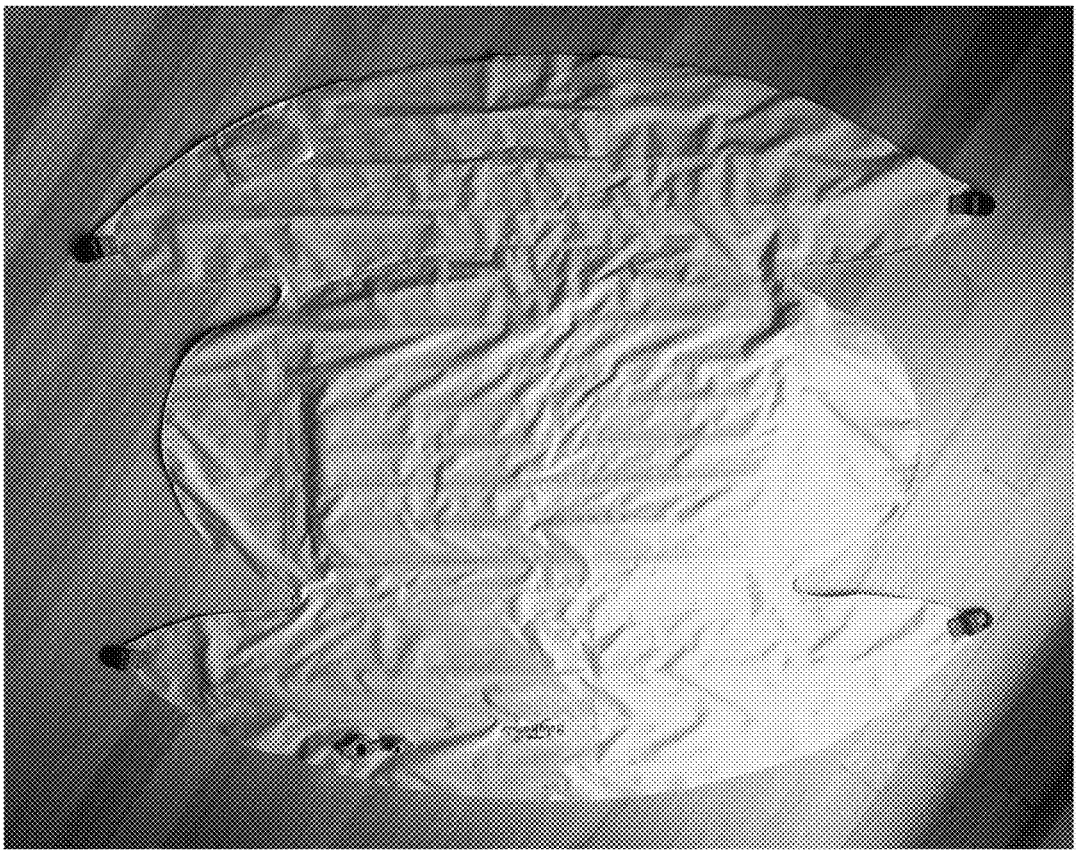
FIG. 34 illustrates a bottom view of the representative embodiment and prototype of FIG. 33.
Figure 37A:
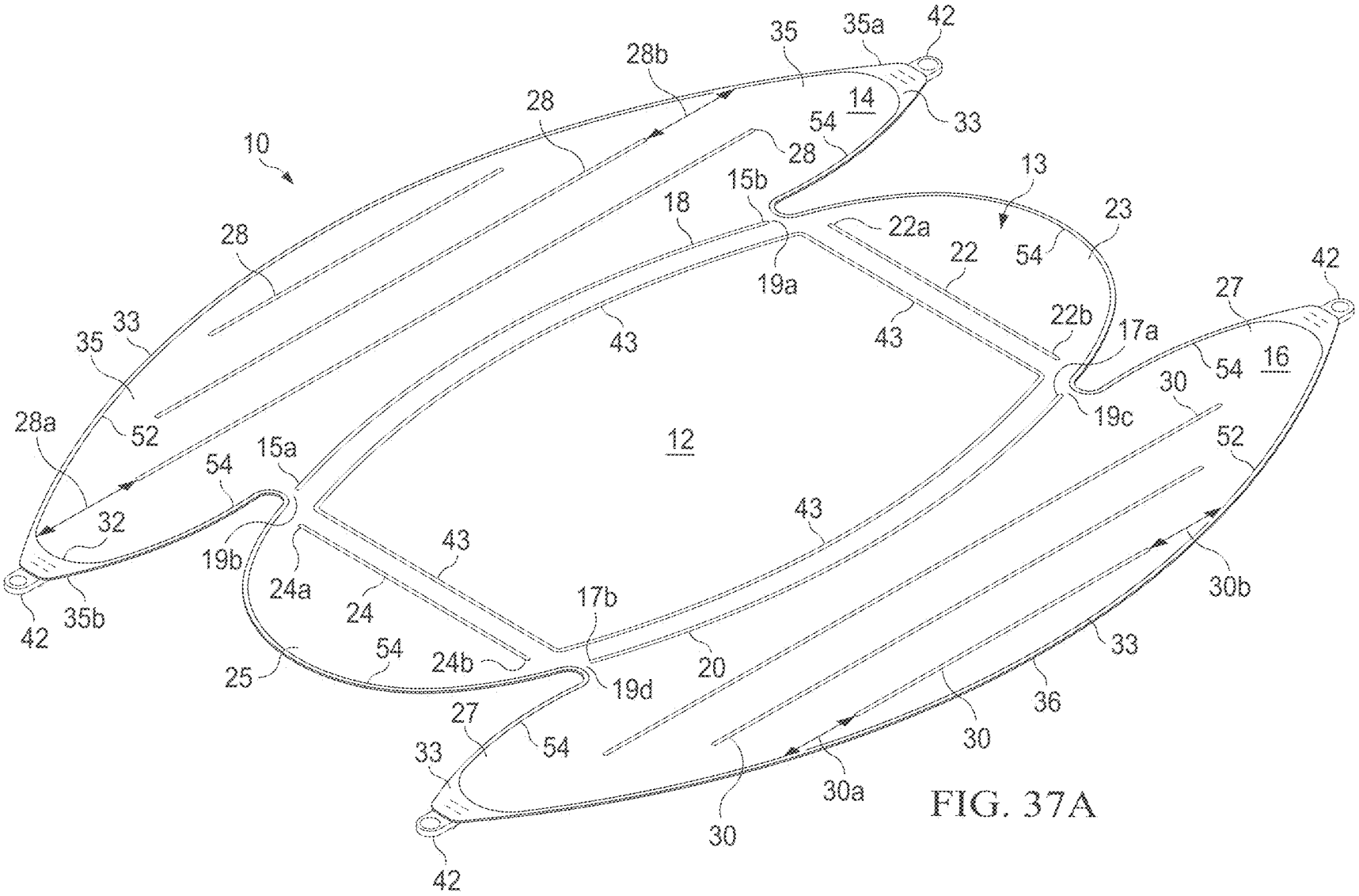
FIGS. 37A, 37B, 38A, 38B, 39-44, 45A, 45B, and 46-55 illustrate various views of the representative embodiments of FIGS. 33-36, including: top perspective view of a device described herein when deflated in an open configuration (FIGS. 37A, 37B, respectively); bottom perspective view of a device described herein in an open configuration (FIGS. 38A, 38B, respectively); front and rear elevation views (or first end and second end elevation views) of FIG. 37A (FIGS. 39, 40 respectively); right and left side views (or first and second side views) of FIG. 37A (FIGS. 41, 42, respectively); top and bottom views of FIGS. 37A and 38A, respectively (FIGS. 43, 44, respectively); top and bottom perspective views of said device when inflated in an open configuration (FIGS. 45A, 45B, respectively); front and rear elevation views (or first end and second end elevation views) of FIG. 45A, 45B (FIGS. 46, 47, respectively); right and left side views (or first and second side views) of FIG. 45A, 45B (FIGS. 48, 49, respectively); top and bottom views of FIGS. 45A, 45B (FIGS. 50, 51, respectively); top and bottom views of a cover described herein (FIGS. 52, 53, respectively); top perspective view of a device described herein when inflated and in a closed configuration, in which the device further comprises a representative cover as described herein (FIG. 54); and bottom view of FIG. 54 (FIG. 55)
Figure 37B:
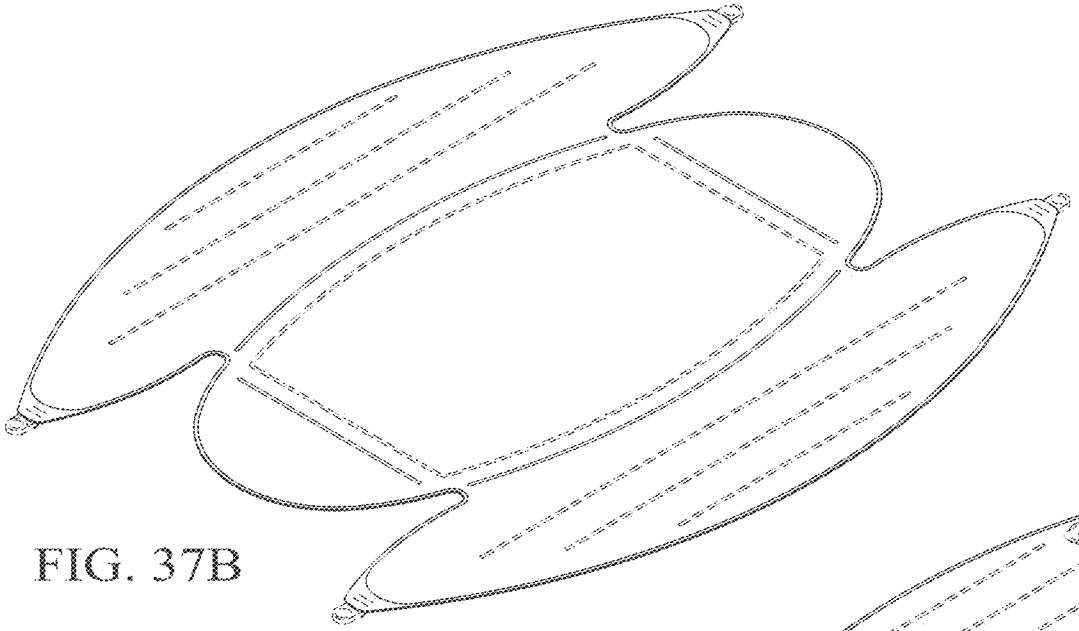
Figure 38B:
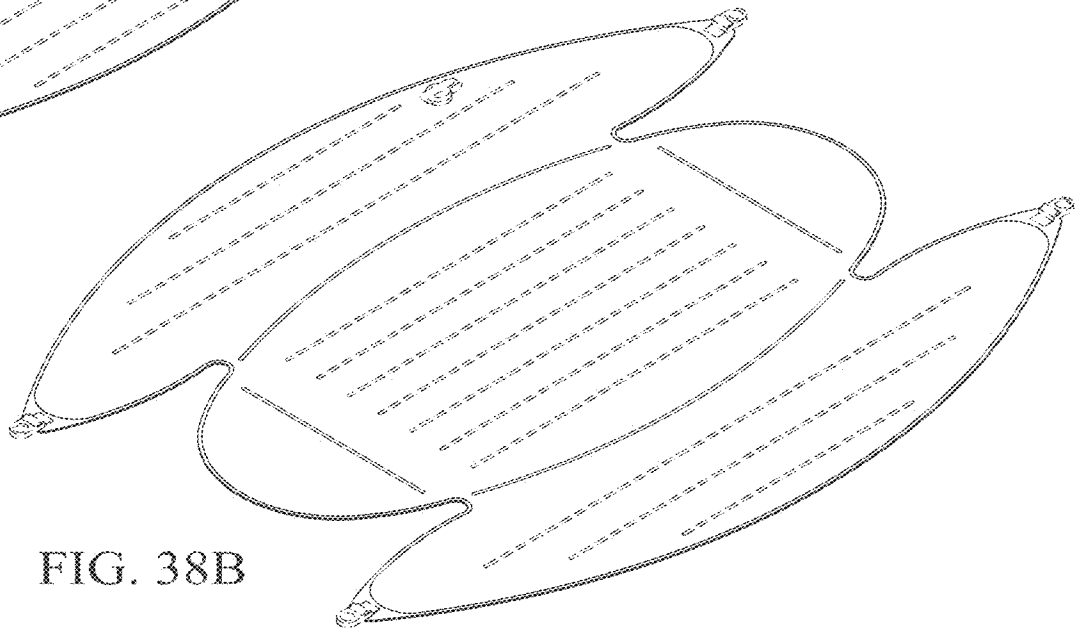
Figure 38A:
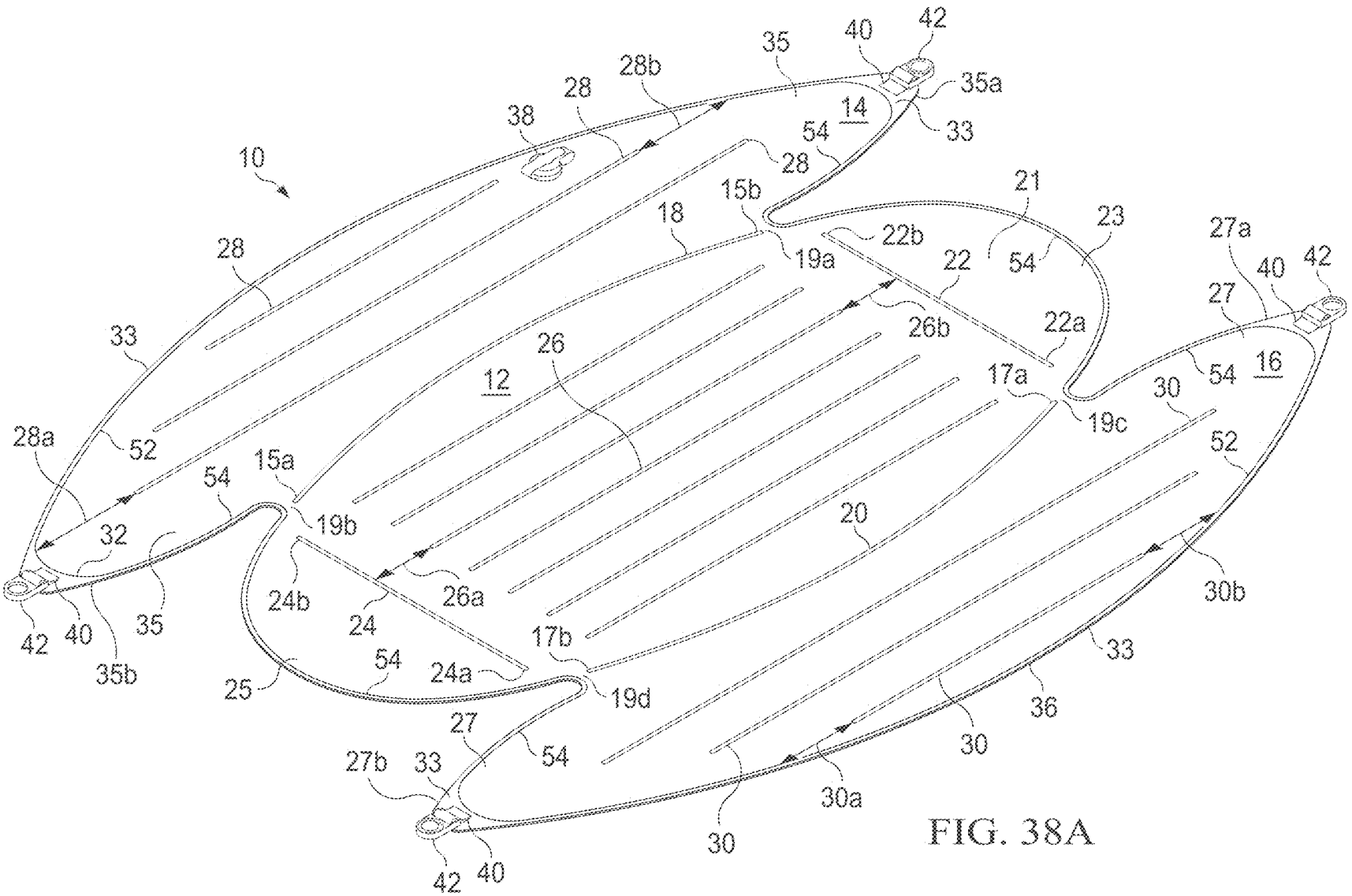
Figure 39:
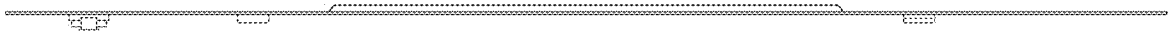
Figure 40:
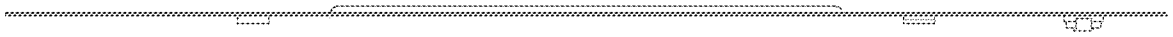
Figure 41:
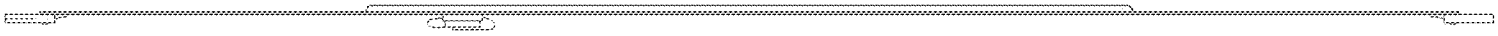
Figure 42:
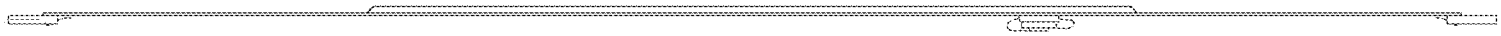
Figure 43:
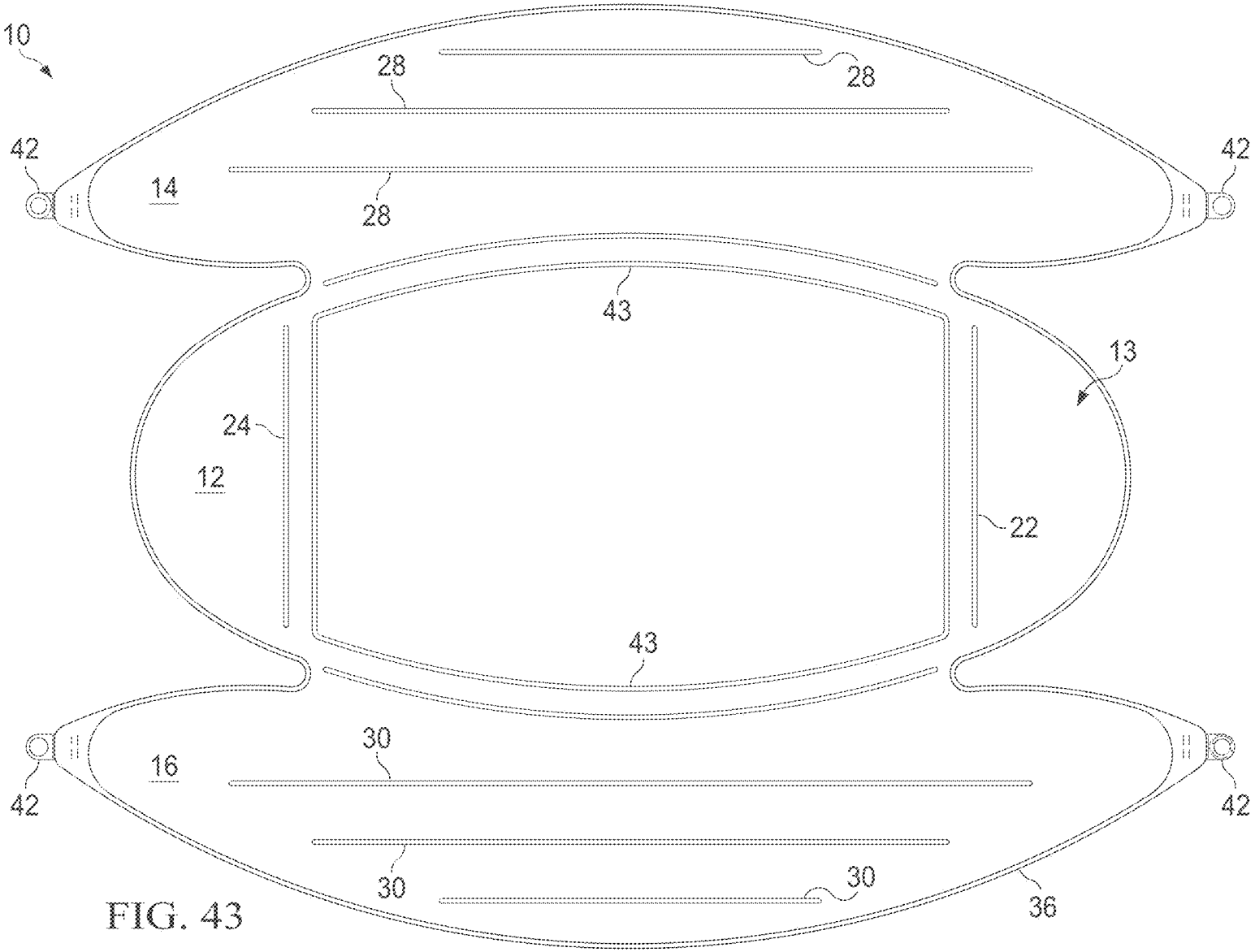
Figure 44:
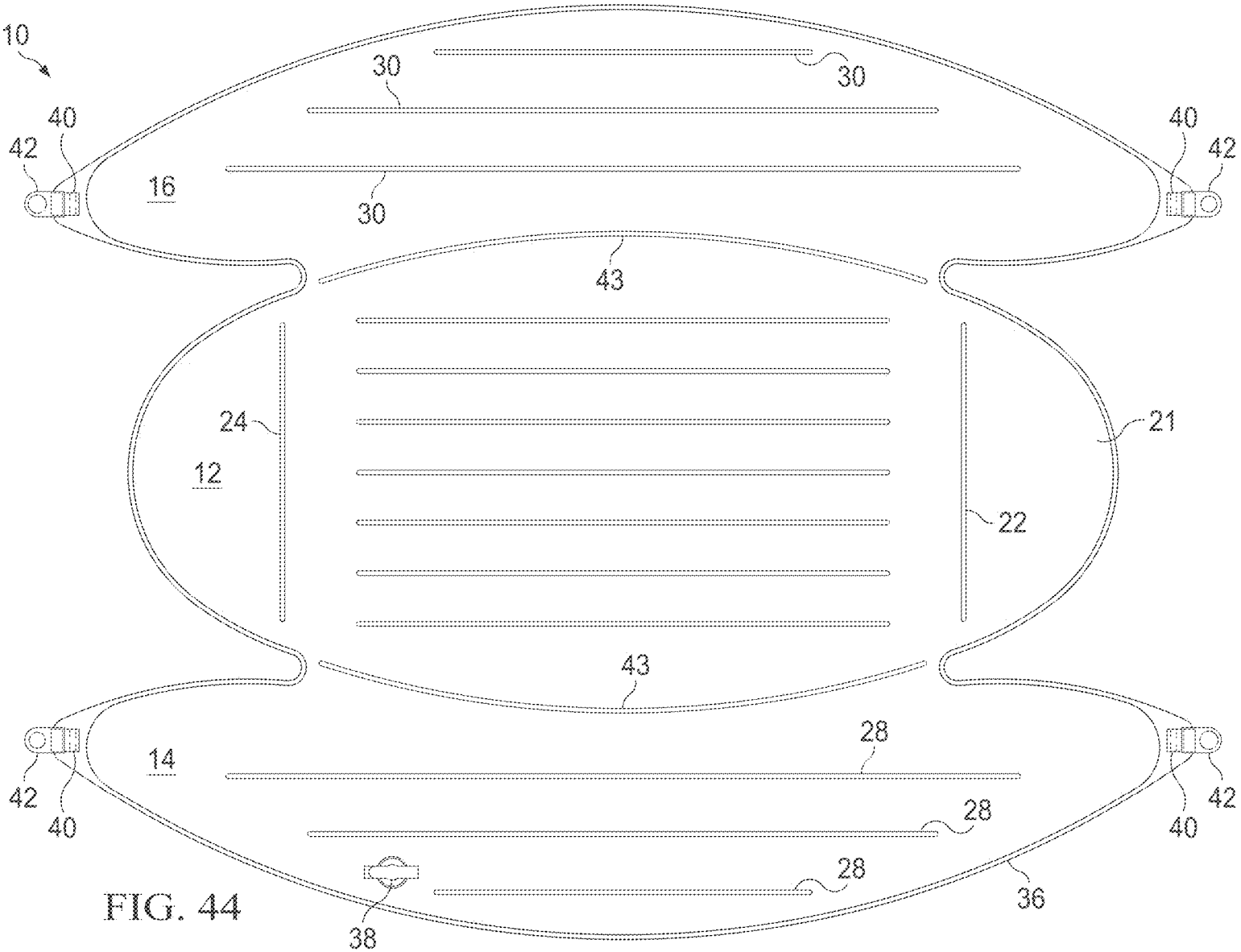
Figure 45A:
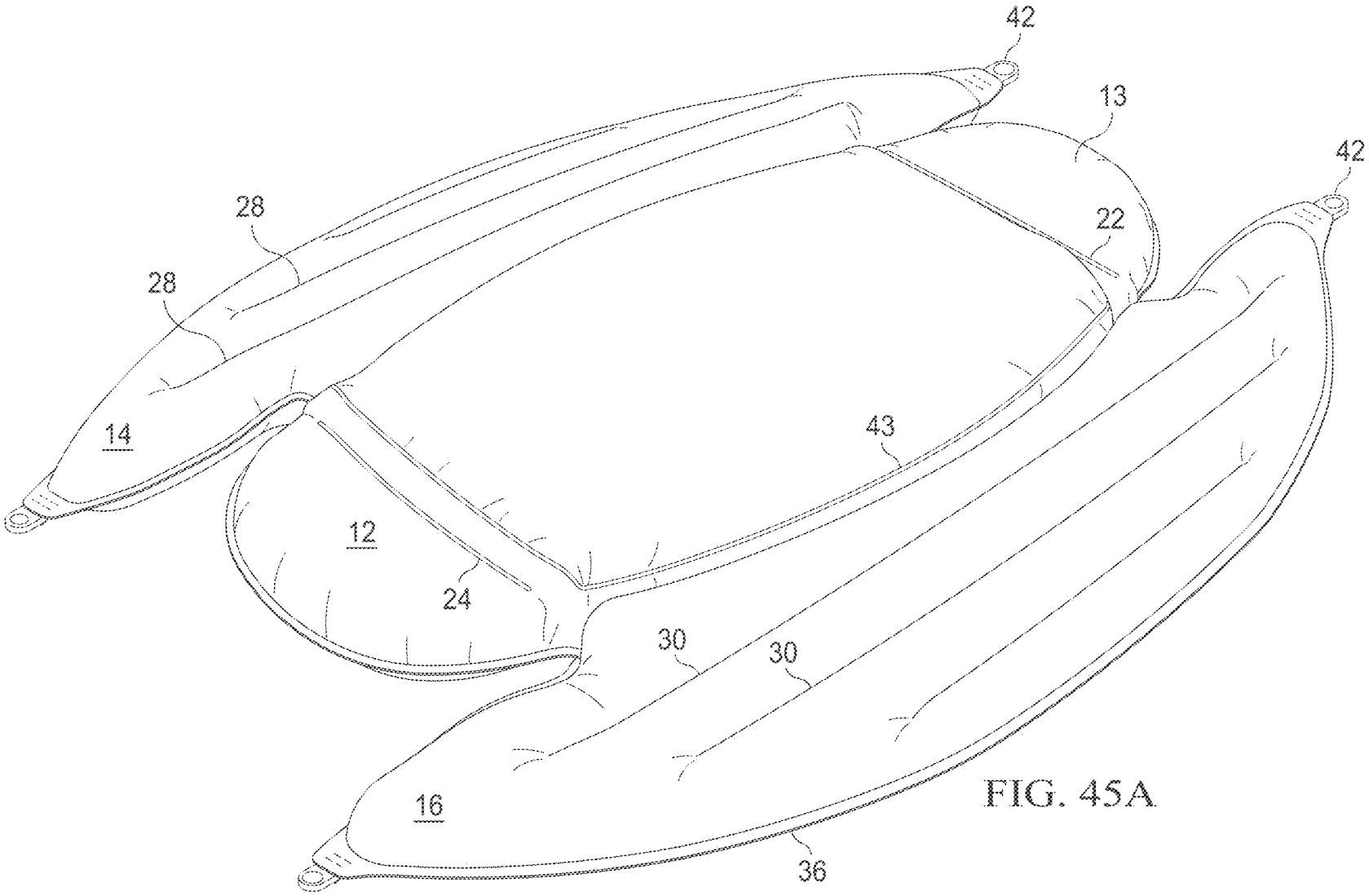
Figure 45B:
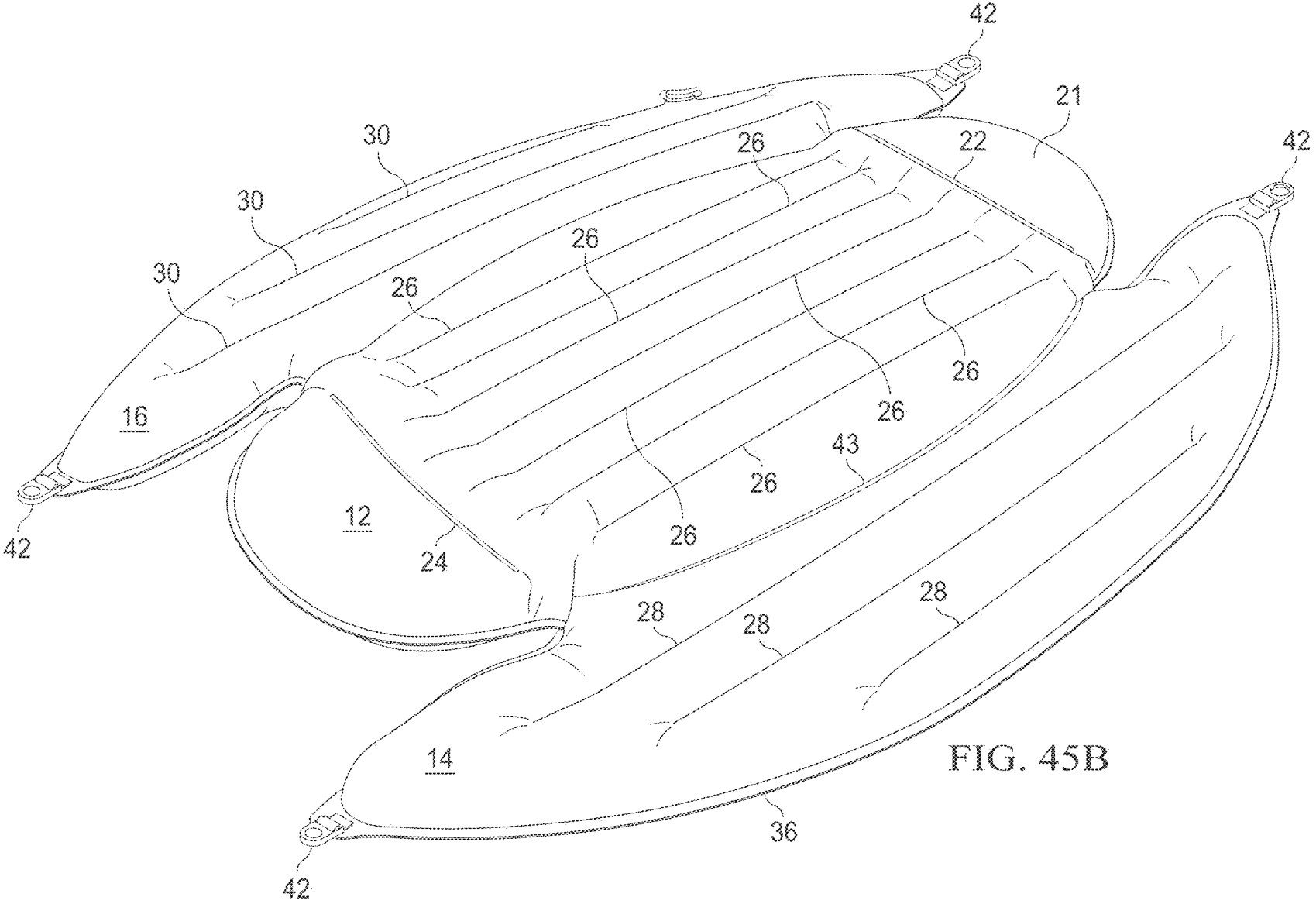
Figure 46:
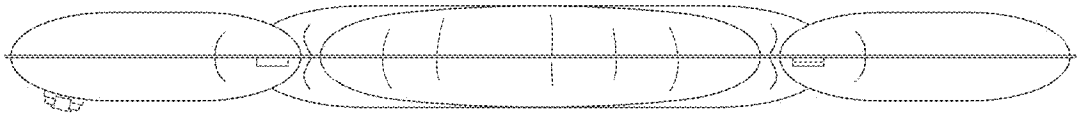
Figure 47:
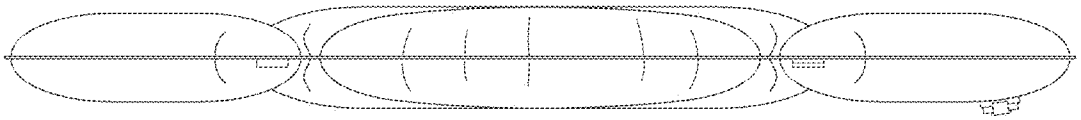
Figure 48:
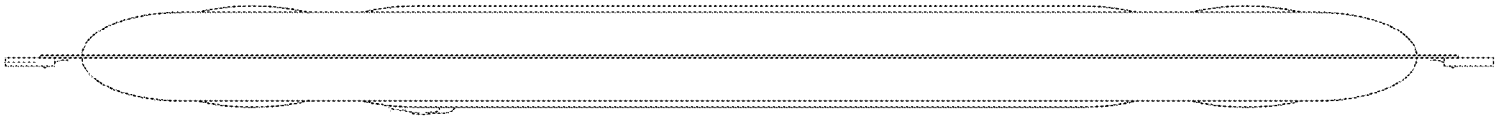
Figure 49:
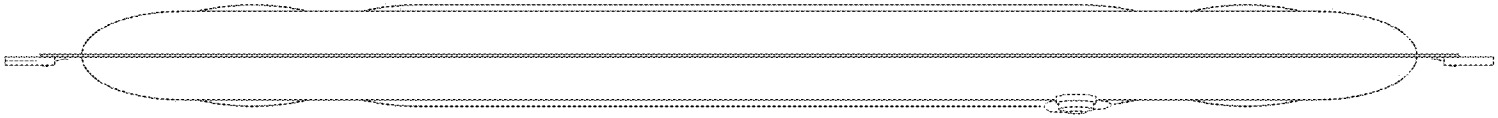
Figure 50:
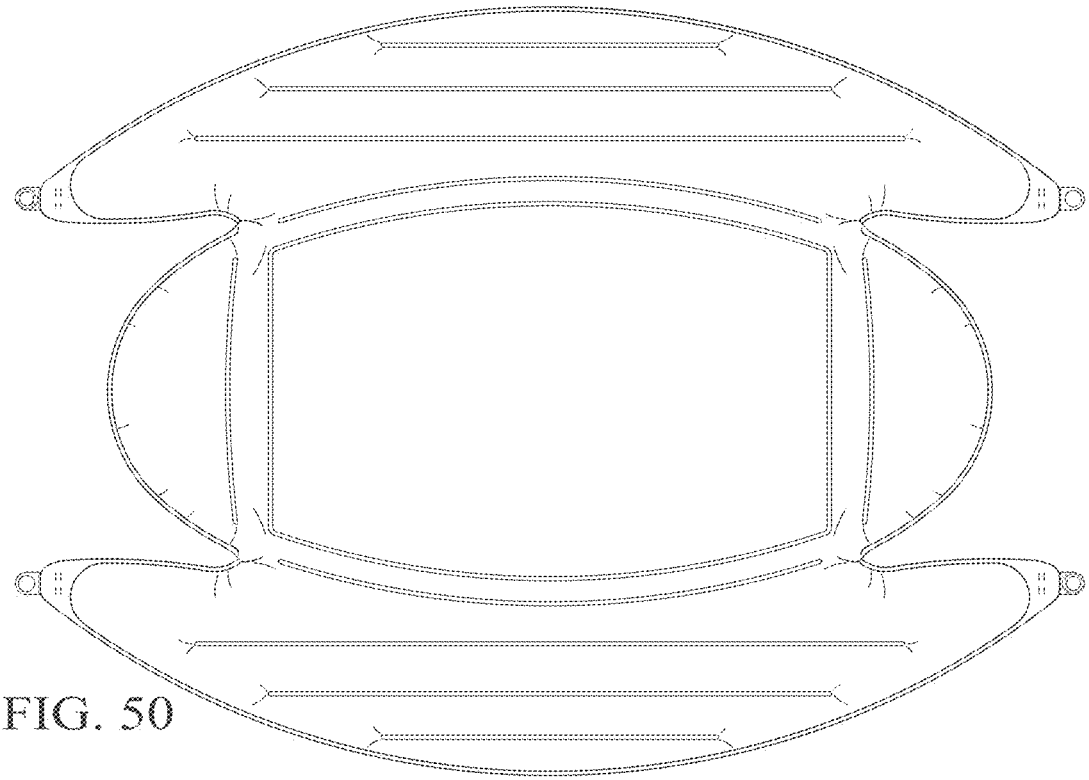
Figure 51:
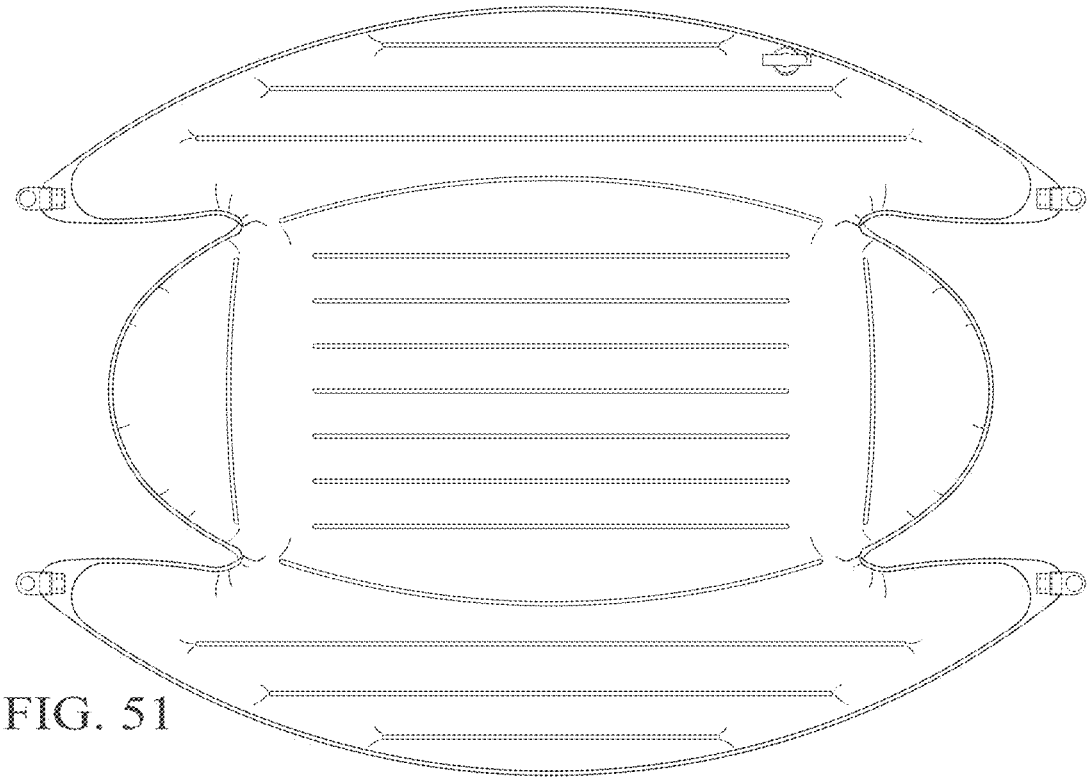

Referring now to FIGS. 33-36, an embodiment of a prototype of a device described herein is depicted, in which FIG. 33 shows a top and top surface of such a device, and FIG. 34 shows a bottom a bottom surface of such a device. FIG. 35 shows a top and top surface of a cover for the device of FIGS. 33 and 34. FIG. 36 shows a bottom and bottom surface of the cover of FIG. 35, which is designed to fittingly encase or coat the device of FIGS. 33 and 34, and therefore provides a very similar overall shape and size, such a shape and size more fittingly encasing or coating the device of FIGS. 33 and 34, when said device is inflated.

Referring now to FIGS. 37-55, the embodiments of FIGS. 33-36 are further illustrated in various views showing device 10, which includes body 12 and wings 14, 16, and in which wing 14 is adjacent a first side of body 12, the first side of body 12 bounded by hinge region (and moveable joint) 18, providing at least a partial separation or partitioning of body 12 and wing 14, and allowing wing 14 to elevate with respect to body 12, when body 12 is coplanar with (e.g., initially coplanar with wing 14) and/or placed on a supporting surface, such as a floor. Wing 16 is positioned adjacent a second side of body 12, the second side of body 12 bounded by hinge region (and moveable joint) 20, which is adjacent the second side of body 12, providing at least a partial separation or partitioning of body 12 and wing 16, and allowing wing 16 to elevate with respect to body 12, when body 12 is coplanar with (e.g., initially coplanar with wing 14) and/or placed on a supporting surface, such as a floor. Hinge region 18 includes only two ends 15*a*, 15*b*, each of which are adjacent gap 19*a* and 19*b*, respectively. Hinge region 20 includes only two ends 17*a*, 17*b*, each of which are adjacent gap 19*c* and 19*d*, respectively. Hinge regions 18, 20 partition wings 14, 16 from body 12. However, the partition in not a complete separation; gaps are provided to allow continuity (e.g., internal continuity) between the body 12 and wings 14, 16. Both, hinge regions 18 and 20 are curvilinear in shape, and, by bounding body 12, they allow body 12 to have a more oval shape.

Body 12 of the device of FIGS. 37-55 also includes hinge region 22 positioned near a first end 23 of body 12, and hinge region 24 positioned near a second end 25 of body 12. Hinge regions 22, 24 have a similar, if not same, overall configuration and gap distance from first and second ends 23, 25, respectively. Hinge regions 22, 24 do not fully separate the mid portion of body 12 from first and second ends 23, 25, respectively. Gaps at ends (22*a*, 22*b*) of hinge region 22 allow continuity (internally) of all of body 12 (e.g., mid portion with first end 23); gaps at ends (24*a*, 24*b*) of hinge region 24 allow continuity (internally) of all of body 12 (e.g., mid portion with second end 25). First and second ends 23, 25, of body 12 are depicted in these figures as curvilinear in shape. Hinge regions 22, 24, provide pillow-like regions between said hinge regions and first and second ends 23, 25, when the described device 10 is inflated. Hinge regions 22, 24, also aid in defining a top surface of body 12 that may be used to support, hold, or otherwise engage a young child or infant. When device 10 (e.g., body 12, wings 14, 16) is inflated and/or fasteners (or fastening means) of device 10 are engaged, hinge regions 22, 24, aid in providing a bottom surface of body 12 that does not elevate (e.g., elevate from a support surface or ground on which the bottom surface of body 12 resides on).

Referring again to wings 14, 16, of the device of FIGS. 37-55, said wings, on opposing sides of body 12 further comprise extending portions 35, 27, respectively. The extending portions 35, 27 each extend sufficiently to allow a first end 35*a* of extending portion 35 to meet with a first end 27*a* of extending portion 27 when device 10 is positioned in a configuration for securing or fastening one or more securements or fasteners (securing means, fastening means 40, 42) that are located at the first end 27*a* and the first end 35*a*. Similarly, extending portions 35, 27 each extend sufficiently to allow a second end 35*b* of extending portion 35 to meet with a second end 27*b* of extending portion 27 when device 10 is positioned in a configuration for securing or fastening one or more securements or fasteners (securing means, fastening means 40, 42) that are located at the second end 27*a* and the second end 35.

As with all devices described herein, device 10 of FIGS. 37-55 includes an air or gas or water bladder having a unique and irregular form (non-polygonal) or overall shape. The device as depicted in FIGS. 37-55 also includes a top 13 (with or having a top surface), a bottom 21 (with or having a bottom surface), an outer edge (36) on or adjacent a periphery (32, 52, 54), in which the outer edge comprises a lip region (33), and a plurality of hinge regions (18, 20, 22, 24). The air or gas or water bladder is bounded by the top 13 and the bottom 21 and the outer edge 36. In this embodiment, the top 13 and the bottom 21 and the outer edge 36 essentially provide a cover for the entirety of the air or gas or water bladder. The air or gas or water bladder is fixedly positioned between top 13 and bottom 21 and the outer edge 36 by a plurality of seams (positioning seams) formed at least as the lip region 33, and the hinge regions 18, 20, 22, 24. Said lip region 33 or peripheral seam is formed by an adhesion, fusion, and/or welding of material of the bladder, top 13, and bottom 21 at the outer edge 36. Similarly, said hinge regions 18, 20, 22, and 24, are formed by an adhesion, fusion, and/or welding of material of the bladder, top 13, and bottom 21 at each hinge region. Between and around said internal seams and said hinge regions of the device, air or gas or water will flow when the device 10 is inflated via the air or gas water bladder. For example, hinge regions 18 do not reach the periphery of the device (interior periphery 32, outer edge 36). Instead, there are gaps 19*a*, 19*b*, at opposing ends of hinge region 18, allowing air flow between the body 12 and wing 14. There are also gaps 19*c*, 19*d*, at opposing ends of hinge region 20, allowing air flow between the body 12 and wing 16 of the device 10, when inflated. Each hinge region (18, 20, 22, 24) provides a moveable portion of the device. Moveable portions or wings 14 and 16 each comprises a plurality of internal seams (28, 30, respectively), and between and around said internal seams and of the device, air or gas or water will flow when the device 10 is inflated via the air or gas water bladder. Internal seams 28, 30, are formed by an adhesion, fusion and/or welding of material of a plurality of layers, which are from the bladder, top 13, and bottom 21. As shown in FIGS. 37-55, internal seams 28 are regularly disposed in wing 14, and internal seams 30 are regularly disposed in wing 16. Said internal seams 28 are provided as linear seams, in a generally parallel alignment, each with a gap 28*a*, 28*b*, at each end of the linear seam. Said internal seams 30 are also provided as linear seams, in a generally parallel alignment, each with a gap 30*a*, 30*b*, at each end of the linear seam.

Referring still to FIGS. 37-51, the device 10 also includes projections 40, 42, at wing extension ends 27*a*, 27*b*, 35*a*, 35*b*, which serve as releasable fasteners (e.g., buckles), sewn or otherwise adhered to said wing extension ends in a suitable manner as is understood in the relevant art. In addition, in a mid-region of the body 12, bounded by top insert boundary 43, and between top 13 and an upper surface of the bladder, a flexible insert is positioned (see, e.g., FIG. 37). In this embodiment, the flexible insert is a high density, fire-retardant foam. The flexible insert prevents adhesion of seams 26 to top 13, and provides a more uniform top surface in the mid-portion of the body 12. A cross-sectional view of the arrangement in a mid-region of body 12 is schematically illustrated in FIG. 56, showing top 13, flexible insert 43, bladder 44, and bottom 21, as described further herein. Adjacent (e.g., above) top 13 and adjacent (e.g., below) bottom 21 is cover 60, as described further herein.

As with the many embodiments described herein, hinge regions 18, 20, 22, 24 of the device 10 of FIGS. 37-51, described herein, partition or provide moveable portions of the device. For example, hinge regions 18 and 20, assist in providing a moveable partition of the first wing and the second wing, respectively, with respect to the body. Hinge regions 18 and 20 allow for the first wing, and the second wing, respectively, to be displaced from a same plane as the body of the device, and to translate into a number of configurations, as well as hold a number of configurations, including at least: (i) the first configuration, which, as described herein, is a deflated configuration (e.g., body, first wing, and second wing, are all in a same plane); (ii) the second configuration, which, as described herein is an inflated configuration; (iii) the third configuration, which, as described herein, is an alternative inflated configuration, in which one or more securing means (e.g., securement or fastening elements 40, 42,) are positioned in a secured or fastened position; and (iv) the fourth configuration, which, as described herein, is a deflated and folded or partially folded configuration. Translation between one or more configurations is described more fully elsewhere. Hinge regions 22 and 24, assist in providing moveable portions of the body region. Hinge regions 22 and 24 allow for the first body end 23, and the second body end 25, respectively, to be displaced from a same plane as the body of the device, and to translate into a number of configurations, as well as to be held in a number of configurations, including at least: (i) the first configuration, which, as described herein, is a deflated configuration (e.g., body, first body end, and second body end, are all in a same plane); (ii) the second configuration, which, as described herein is an inflated configuration; (iii) the third configuration, which, as described herein, is an alternative inflated configuration, in which one or more securing means (e.g., securement or fastening elements 40, 42,) are positioned in a secured or fastened position; and (iv) the fourth configuration, which, as described herein, is a deflated and folded or partially folded configuration. Hinge regions 22 and 24 allow for an elevated position of portions of the body region of the device (e.g., providing more pillow-like portions at first and second body ends 23, and 25), when the device is inflated, and/or when the device is inflated and in a closed configuration (e.g., as depicted in FIG. 54).

The embodiments of FIGS. 37-51 may also include a further layer or cover 60, as depicted in FIGS. 52-54. The cover 60 is a further layer encasing device 10, and is removable. In this embodiment, cover 60 encased or coats most of device 10, having a top with a top surface 62, and a bottom with a bottom surface 66. Cover 60 is provided in generally the same form and shape as device 10, and, together with the addition of cuffs 64, these features help to prevent dislocation of the cover 60 (with respect to the device 10). Cover 60 further comprises an opening and closing means or securement 65, which in one or more embodiments may be a zipper. For the representative cover 60 depicted in FIGS. 52-54, securement 65 or opening and closing means is formed as an invisible opening and closing, in which the means for opening and closing (e.g., zipper) is hidden along a peripheral seam formed between the top with the top surface 62 and the bottom with the bottom surface 66. In one or more embodiments, the cover 60 of FIGS. 35, 36, and 52-54 are formed with a peripheral seam uniting the top with the top surface 62, and the bottom with the bottom surface 66. The cover 60 of FIGS. 52-54 further includes straps 68, formed of a frictional material, to assist in reducing slip of device 10 (e.g., with respect to a supporting surface or ground, on which the device 10 may be positioned on). In the embodiment of FIGS. 52-54, cover 60 is formed of the same material as top 13 and bottom 21 of device 10, being a thermoplastic polyurethane, which may be cleaned, is washable, and is a hygienic material.

Figure 55:
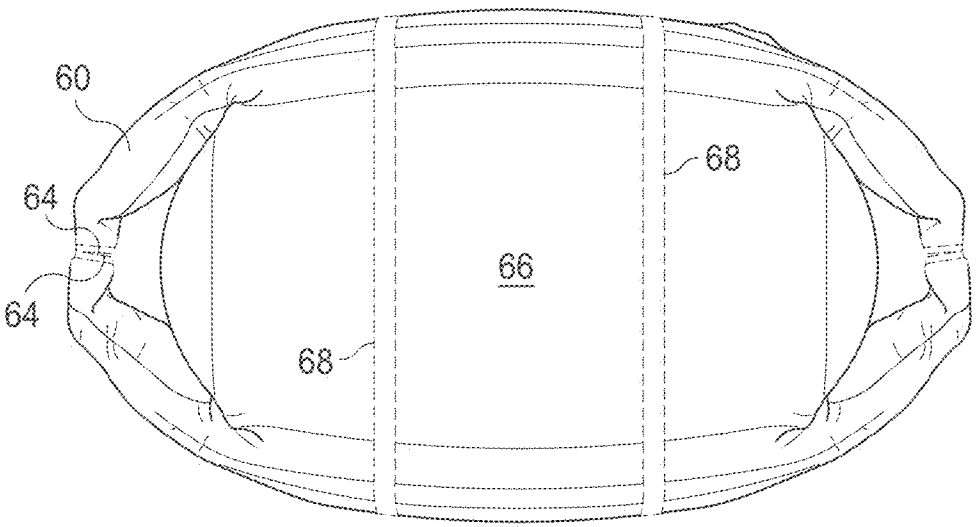

Referring to FIGS. 54 and 55, top perspective and bottom views, respectively of the device 10 (of FIGS. 37-51, and the cover 60 (of at least FIGS. 52, 53), are shown, in which the cover 60 is covering, encasing or coating the device 10. In these examples, cover 60 fully covers or encases the device 10 when the device 10 is inflated and provided in a closed position (e.g., secured or fastened with fasteners or means for securing or fastening 40, 42) position, and in such a way that fasteners or the means for securing or fastening 40, 42, are generally hidden by cover 60 having sleeves and cuffs 64. Of course, sleeves and cuffs are merely representative, and alternatives to cuffs 64 are certainly contemplated and possible, including no cuffs, and/or cuffs with snaps, and/or ends with or without clasps, and/or ends with or without folds, and the like, as is understood by a person of skill in the art, and in view of the drawings and disclosure herein.

FIG. 56 provides a schematic of a cross section of a device, such as that represented in FIGS. 54 and 55, in which the cross section is taken in a mid-portion of the body section 12 of a device 10, and showing a cover 60, in which the top with the top surface 62 of the cover 60 is above the top 13 of the device 10, which is above a foam or insert 43, which is above a bladder 44 (comprising internal seam 26 and cells 45, as shown), which is above bottom 21 of the device 10, which is above the bottom with the bottom surface 66 of the cover 60.

The terms "a" and "an" do not denote a limitation of quantity, and represent the presence of at least one of the referred item.

The foregoing description provides representations and examples embodying, at least in part, teachings of the invention. The invention, as defined by the appended claims, is not limited to the described embodiments. Alterations and modifications to the disclosed embodiments may be made without departing from the invention. The meaning of the terms used in this specification are, unless expressly stated otherwise, intended to have ordinary and customary meaning and are not intended to be limited to the details of the illustrated structures or the disclosed embodiments. Although the foregoing description of embodiments have shown, described and pointed out certain novel features of the invention, it will be understood that various omissions, substitutions, and changes in the form of detail as illustrated as well as the uses thereof, may be made by those skilled in the art, without departing from the invention. Particularly, it will be appreciated that the one or more embodiments may manifest itself in other configurations as appropriate for the end use of the device made thereby.

What is embodied or claimed is:

1. A device for supporting or holding a young child or infant, the device comprising:

a top;

a bottom;

an outer edge forming a periphery, in which the outer edge further comprises a lip at the periphery; and an air or gas bladder contained between the top and the bottom, and bounded by at least a portion of the lip of the outer edge, the device having a unique and irregular or non-polygonal form, being further defined by a plurality of internal seams, the plurality of internal seams so placed so as to form at least three definable regions comprising a first wing region, a second wing region and a body region, at least one of the plurality of internal seams being utilized for forming the first wing region on a first side of the body, the body region of the device located centrally, at least one of the plurality of seams being utilizing for forming the second wing region on a second side of the centrally located body region of the device, and the first and second wing regions each comprising a portion of the top and a portion of the bottom, the device inflatable via the air or gas bladder to expand the device between the top and the bottom, and the device further operable between a first or open position and a second or closed position, wherein the closed position raises at least a portion of the bottom of the first and second wing regions away from a plane or a surface on which the device is positioned when in the open position, wherein the first wing region and second wing region each comprise a first end and an opposing second end, and one or more projections are independently secured to each of the first end and the opposing second end of each of the first wing region and the second wing region.

2. The device of claim 1, wherein at least some of the internal seams are formed by fusing or welding.

3. The device of claim 1, wherein the one or more projections are for cooperatively engaging an end portion of the first wing region with an end portion of the second wing region.

4. The device of claim 1, wherein the one or more projections independently secured to each of the first wing region and the second wing region are selected from a group comprising one or more enclosures, fasteners, clasps, belts, buckle hooks and loops, clips, locks, chains, zips, buttons and holes, pins, hoops, retaining rings, anchors, carabiners, and combinations thereof.

5. The device of claim 1, wherein the one or more projections independently secured to each of the first wing region and the second wing region are utilized to operate the device between the first or open position and the second or closed position, wherein at least a first projection secured to a first end of a first wing region cooperatively engages with a second projection secured to a first end of a second wing region in the second or closed position.

6. The device of claim 1 further comprising at least one gas or air inlet utilized for inflating the air or gas bladder.

7. The device of claim 1, wherein the device further comprises one or more of the group comprising at least one handle, and an overhead element.

8. The device of claim 1 further comprising a cover.

9. The device of claim 1 further comprising padding.

10. The device of claim 1 further comprising one or more of an access hole, holder, pocket, overhead companion, and a pump or inflating mechanism, any or all of which may be cooperative with the device.

11. The device of claim 1 further comprising one or more hinge regions for movement of the device from a first device position, in a first plane being a same plane, to a second device position, in second plane, wherein at least a first hinge region is located between the first wing region and the centrally located body region of the device, and at least a second hinge region is located between the second wing region and the centrally located body region of the device.

12. The device of claim 1 further comprising one or more handles.

13. The device of claim 1 further comprising a micro-pump.

14. The device of claim 1 further comprising a first cover and a second cover.

15. The device of claim 1 further comprising at least one cover with at least one handle.

16. The device of claim 14 wherein one of the first cover or the second cover is a case for any one of storing and carrying the device.

17. Use of the device of claim 1 for support of the young child or infant.

18. A method of preparing the device of claim 1, the method comprising:

inflating the device; and fastening wings of the device to each other.

19. The method of claim 18, wherein the method further comprises providing the young child or infant on the centrally located body region of the device when the centrally located body region of the device is inflated.

20. The method of claim 18, wherein the method further comprises providing a cover over at least the centrally located body region of the device, the cover being present when the centrally located body region of the device is inflated.

* * * * *